US008995846B2

(12) United States Patent
Itabashi et al.

(10) Patent No.: US 8,995,846 B2
(45) Date of Patent: Mar. 31, 2015

(54) CARTRIDGE MOUNTABLE ON IMAGE-FORMING APPARATUS

(75) Inventors: Nao Itabashi, Aichi (JP); Naoya Kamimura, Aichi (JP); Motoaki Mushika, Gifu (JP); Yasuo Fukamachi, Aichi (JP); Masamitsu Ukai, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 54 days.

(21) Appl. No.: 13/598,859

(22) Filed: Aug. 30, 2012

(65) Prior Publication Data

US 2013/0051814 A1 Feb. 28, 2013

(30) Foreign Application Priority Data

Aug. 31, 2011 (JP) ..... 2011-190042

(51) Int. Cl.
*G03G 15/00* (2006.01)
*G03G 15/08* (2006.01)
*G03G 21/18* (2006.01)

(52) U.S. Cl.
CPC ..... *G03G 21/1857* (2013.01); *G03G 21/1896* (2013.01)
USPC ..... 399/12; 399/27; 399/111

(58) Field of Classification Search
CPC ..... G03G 21/1896; G03G 21/1857; G03G 21/1875; G03G 2221/1663
USPC ..... 399/12, 25, 27, 110, 111, 119, 262
See application file for complete search history.

(56) References Cited

U.S. PATENT DOCUMENTS

| | | | |
|---|---|---|---|
| 5,053,816 | A | 10/1991 | Takahashi |
| 5,430,780 | A | 7/1995 | Takeda et al. |
| 6,298,202 | B1 | 10/2001 | Fushiya et al. |
| 6,654,583 | B2 | 11/2003 | Suzuki et al. |
| 6,792,217 | B2 | 9/2004 | Nishino et al. |

(Continued)

FOREIGN PATENT DOCUMENTS

| | | | |
|---|---|---|---|
| CN | 1828446 | A | 9/2006 |
| CN | 101256382 | A | 9/2008 |

(Continued)

OTHER PUBLICATIONS

Extended EP Search Report dtd Mar. 5, 2013, EP Appln. 12182298.5.

(Continued)

*Primary Examiner* — Sophia S Chen
(74) *Attorney, Agent, or Firm* — Banner & Witcoff, Ltd.

(57) ABSTRACT

A receiving member is configured to receive a driving force from outside, is mounted on a first side wall on an opposite side from a developer accommodating portion, and is rotatable around a first axis line parallel to the longitudinal direction. A rotating member is rotatably provided between the first and second side walls, and configured to be rotated by the driving force received by the receiving member. A detection body is mounted on the second side wall on an opposite side from the developer accommodating portion and includes a detected part which is detected by a detecting unit. The detection body advances outwards in the longitudinal direction with respect to the second side wall and retracts inwards in the longitudinal direction with respect to the second side wall by the driving force received by the receiving member.

51 Claims, 17 Drawing Sheets

(56) References Cited

U.S. PATENT DOCUMENTS

| | | | | |
|---|---|---|---|---|
| 7,027,756 | B2 | 4/2006 | Hoshi et al. | |
| 7,076,179 | B2 | 7/2006 | Nakazato | |
| 7,218,869 | B2 | 5/2007 | Nakazato | |
| 7,418,214 | B2 | 8/2008 | Yoshida et al. | |
| 7,512,347 | B2 | 3/2009 | Suzuki et al. | |
| 7,574,148 | B2 | 8/2009 | Igarashi et al. | |
| 7,613,414 | B2 | 11/2009 | Kamimura | |
| 7,953,330 | B2 | 5/2011 | Ishikawa | |
| 7,970,293 | B2 | 6/2011 | Ishikawa et al. | |
| 7,978,997 | B2 | 7/2011 | Tokuda | |
| 8,009,996 | B2 | 8/2011 | Ishikawa | |
| 8,090,272 | B2 | 1/2012 | Ishikawa | |
| 8,463,145 | B2 | 6/2013 | Ukai et al. | |
| 2003/0185579 | A1 | 10/2003 | Nishino et al. | |
| 2004/0223772 | A1 | 11/2004 | Nakazato | |
| 2005/0117935 | A1 | 6/2005 | Hoshi et al. | |
| 2006/0034625 | A1 | 2/2006 | Kajikawa | |
| 2006/0159487 | A1 | 7/2006 | Choi et al. | |
| 2006/0193646 | A1 | 8/2006 | Suzuki et al. | |
| 2006/0210285 | A1 | 9/2006 | Nakazato | |
| 2007/0059018 | A1 | 3/2007 | Tokuda | |
| 2007/0122165 | A1 | 5/2007 | Igarashi et al. | |
| 2007/0122176 | A1 | 5/2007 | Sato | |
| 2007/0140709 | A1 | 6/2007 | Yoshida et al. | |
| 2007/0140725 | A1 | 6/2007 | Kamimura | |
| 2008/0205911 | A1 | 8/2008 | Ishikawa et al. | |
| 2008/0205928 | A1 | 8/2008 | Ishikawa | |
| 2008/0205931 | A1 | 8/2008 | Ishikawa | |
| 2008/0223173 | A1 | 9/2008 | Ishikawa | |
| 2011/0243578 | A1 | 10/2011 | Ukai et al. | |
| 2012/0051795 | A1* | 3/2012 | Mushika et al. | 399/262 |
| 2013/0051813 | A1 | 2/2013 | Itabashi et al. | |
| 2013/0051815 | A1 | 2/2013 | Itabashi et al. | |
| 2013/0051816 | A1 | 2/2013 | Itabashi | |
| 2013/0051833 | A1 | 2/2013 | Itabashi et al. | |
| 2013/0084081 | A1 | 4/2013 | Itabashi et al. | |
| 2013/0084082 | A1 | 4/2013 | Itabashi et al. | |
| 2013/0084083 | A1 | 4/2013 | Itabashi et al. | |
| 2013/0084084 | A1 | 4/2013 | Itabashi et al. | |
| 2013/0177326 | A1 | 7/2013 | Hamaya | |

FOREIGN PATENT DOCUMENTS

| | | | |
|---|---|---|---|
| CN | 201464807 | U | 5/2010 |
| CN | 201489284 | U | 5/2010 |
| EP | 1696284 | A2 | 8/2006 |
| EP | 1950625 | A2 | 7/2008 |
| EP | 2365402 | A2 | 9/2011 |
| JP | S63-118042 | U | 7/1988 |
| JP | H02-78949 | U | 6/1990 |
| JP | H02-262168 | A | 10/1990 |
| JP | H03-212656 | A | 9/1991 |
| JP | 03-279965 | A | 12/1991 |
| JP | 4-31156 | U | 3/1992 |
| JP | H04-191773 | A | 7/1992 |
| JP | H04-112263 | U | 9/1992 |
| JP | H04-114057 | U | 10/1992 |
| JP | 06-202403 | A | 7/1994 |
| JP | H07-160173 | A | 6/1995 |
| JP | 09-171340 | A | 6/1997 |
| JP | 09-190136 | A | 7/1997 |
| JP | H11-84850 | A | 3/1999 |
| JP | 2001222204 | A | 8/2001 |
| JP | 2002-169449 | A | 6/2002 |
| JP | 2003-271039 | A | 9/2003 |
| JP | 2004-286951 | A | 10/2004 |
| JP | 2005-164751 | A | 6/2005 |
| JP | 2006-235236 | A | 9/2006 |
| JP | 2006-267994 | A | 10/2006 |
| JP | 2006-337401 | A | 12/2006 |
| JP | 2007-079284 | A | 3/2007 |
| JP | 2007-093753 | A | 4/2007 |
| JP | 2007-148285 | A | 6/2007 |
| JP | 2007-164095 | A | 6/2007 |
| JP | 2008-216391 | A | 9/2008 |
| JP | 2008-216392 | A | 9/2008 |
| JP | 2008-216393 | A | 9/2008 |
| JP | 2009-175293 | A | 8/2009 |
| JP | 2009-180984 | A | 8/2009 |
| JP | 2009-223017 | A | 10/2009 |
| JP | 2009-288549 | A | 12/2009 |
| JP | 2010-039437 | A | 2/2010 |
| JP | 2011-013323 | A | 1/2011 |
| JP | 2011-075986 | A | 4/2011 |
| JP | 2011-215374 | A | 10/2011 |

OTHER PUBLICATIONS

Extended EP Search Report mailed Apr. 17, 2013, EP Appln. 12182300.9.

JP Office Action mailed Jul. 23, 2013, JP Appln. 2011-190035, English translation.

International Search Report and Written Opinion dtd Oct. 23, 2012, PCT/JP2012/071955.

Non Final Office Action issued in corresponding U.S. Appl. No. 13/598,895, mailed Dec. 20, 2013.

CN Notification of the First Office Action mailed Mar. 5, 2014, CN Appln. 201210324350.4, English translation.

International Preliminary Report on Patentability mailed Mar. 13, 2014, PCT/JP2012/071955.

CN Notification of the First Office Action mailed Mar. 5, 2014, CN Appin. 201210324506.9, English translation.

CN Notification of the First Office Action mailed Mar. 25, 2014, CN Appln. 201210324571.1, English translation.

Notice of Allowance issued in U.S. Appl. No. 13/598,717 mailed Apr. 7, 2014.

Non-Final Office Action received in corresponding U.S. Appl. No. 13/599,157 mailed Jun. 19, 2014.

Aug. 27, 2014—(EP) Extended Search Report—App 12182301.7.

Oct. 2, 2014—(EP) Extended Search Report—App 12182299.3.

Oct. 16 , 2014—(US) Final Office Action—U.S. Appl. No. 13/599,157.

Nov. 19, 2014—(US) Notice of Allowance—U.S. Appl. No. 13/598,708.

Oct. 27, 2014—(US) Notice of Allowance—U.S. Appl. No. 13/598,895.

Feb. 3, 2015—(CN) Notification of the Second Office Action—App 201210324374.X, Eng Tran.

* cited by examiner

CARTRIDGE MOUNTABLE ON IMAGE-FORMING APPARATUS

CROSS REFERENCE TO RELATED APPLICATION

This application claims priority from Japanese Patent Application No. 2011-190042 filed Aug. 31, 2011. The entire content of the priority application is incorporated herein by reference.

TECHNICAL FIELD

The disclosure relates to a cartridge mountable on an image-forming apparatus employing an electrophotographic system.

BACKGROUND

There is disclosed an image forming apparatus, such as a laser printer, of a type that a developing cartridge is attached to the main body of the apparatus as to be detachable therefrom (See Japanese Unexamined Patent Application Publication No. 2006-267994). The developing cartridge contains a developer. When the developing cartridge runs out of the developer, the cartridge is removed from the main body of the apparatus. Then, a new developing cartridge is attached to the main body. Furthermore, when the apparatus cause a paper jam within the main body, the developing cartridge may be removed from the main body to eliminate such a paper jam, and then attached again to the main body.

In the image forming apparatus of this type, it is suggested how to determine whether the developing cartridge is a brand-new or used one when attached to the main body as a way to find out the wear of the developing cartridge.

On the side surface of such developing cartridge is a detecting gear mounted, and the detecting gear is rotatable around an axis line (rotation axis line) extending in a transverse direction crossing the side surface at a right angle. The detecting gear has a plate-shaped detecting gear body and a contact protrusion integrally formed with the detecting gear body on the outer side (the opposite surface to the side of the developing cartridge with respect to the detecting gear body) of the detecting gear body. The detecting gear body has gear teeth on its circumferential surface (except some portion of the circumferential surface).

Further, a transmission gear is provided on the side surface of the developing cartridge, and the transmission gear is rotatable around an axis line extending parallel to the axis line of the detecting gear at a distance. The transmission gear rotates as a whole with an agitator for agitating the developer contained in the developing cartridge. The transmission gear has gear teeth on its entire circumferential surface.

In a new developing cartridge, the gear teeth of the transmission gear are engaged with the gear teeth of the detecting gear. When the developing cartridge is attached to the main body, the driving force of a motor is delivered to the transmission gear, and further transmitted from the transmission gear to the detecting gear through those gear teeth.

This allows the detecting gear to rotate, and the contact protrusion to move in the rotational direction of the detecting gear in response to the rotation of the detecting gear. When the toothless portion of the detecting gear faces the gear teeth of the transmission gear, the gear teeth of the transmission gear is disengaged with the gear teeth of the detecting gear, and the rotation of the detecting gear stops. Thus, if the developing cartridge is ever attached to the main body, the gear teeth of the transmission gear is disengaged with the gear teeth of the detecting gear, and such position remains afterwards.

In the main body is a sensor mounted for detecting the penetration of the contact protrusion, given that the contact protrusion is a detected part. Then, based on the detection result as to the penetration of the contact protrusion by the sensor, an old or new developing cartridge is determined. In other words, after a developing cartridge is attached to the main body, the developing cartridge is determined new if the sensor detects the penetration of the contact protrusion. On the other hands, after a developing cartridge is attached to the main body, the developing cartridge is determined old if the sensor does not detect the penetration of the contact protrusion.

SUMMARY

However, the contact protrusion may touch or catch other members in the main body of the apparatus when the developing cartridge is attached to, or removed from, the main body, because the contact protrusion is mounted to project outwards from the side of the developing cartridge. Moreover, if the developing cartridge is removed from the main body of the apparatus, the contact protrusion may be damaged by, for example, a collision with other members when the developing cartridge is manipulated by end users.

The aspect of the embodiment is to provide a cartridge for preventing the damage of the detected part by, for example, a collision with other members.

In order to attain the above and other objects, there is provided a cartridge including a housing, a receiving member, a rotating member, and a detection body. The housing includes a developer accommodating portion configured to accommodate a developer therein, a first side wall, and a second side wall opposed to the first side wall in a longitudinal direction. The developer accommodating portion is interposed between the first side wall and the second side wall. The receiving member is configured to receive a driving force from outside, is located at an opposite side from the developer accommodating portion with respect to the first side wall, and is rotatable around a first axis line extending parallel to the longitudinal direction. The rotating member is provided between the first and second side walls so as to be rotatable around a second axis line extending parallel to the first axis line, and configured to be rotated by the driving force received by the receiving member. The detection body is located at an opposite side from the developer accommodating portion with respect to the second side wall and includes a detected part which is configured to be detected by an external detecting unit. The detection body is configured to advance outwards in the longitudinal direction with respect to the second side wall and retract inwards in the longitudinal direction with respect to the second side wall by the driving force received by the receiving member which is transferred through the rotating member.

DETAILED DESCRIPTION

1. General Configuration of Laser Printer

Figure 1:
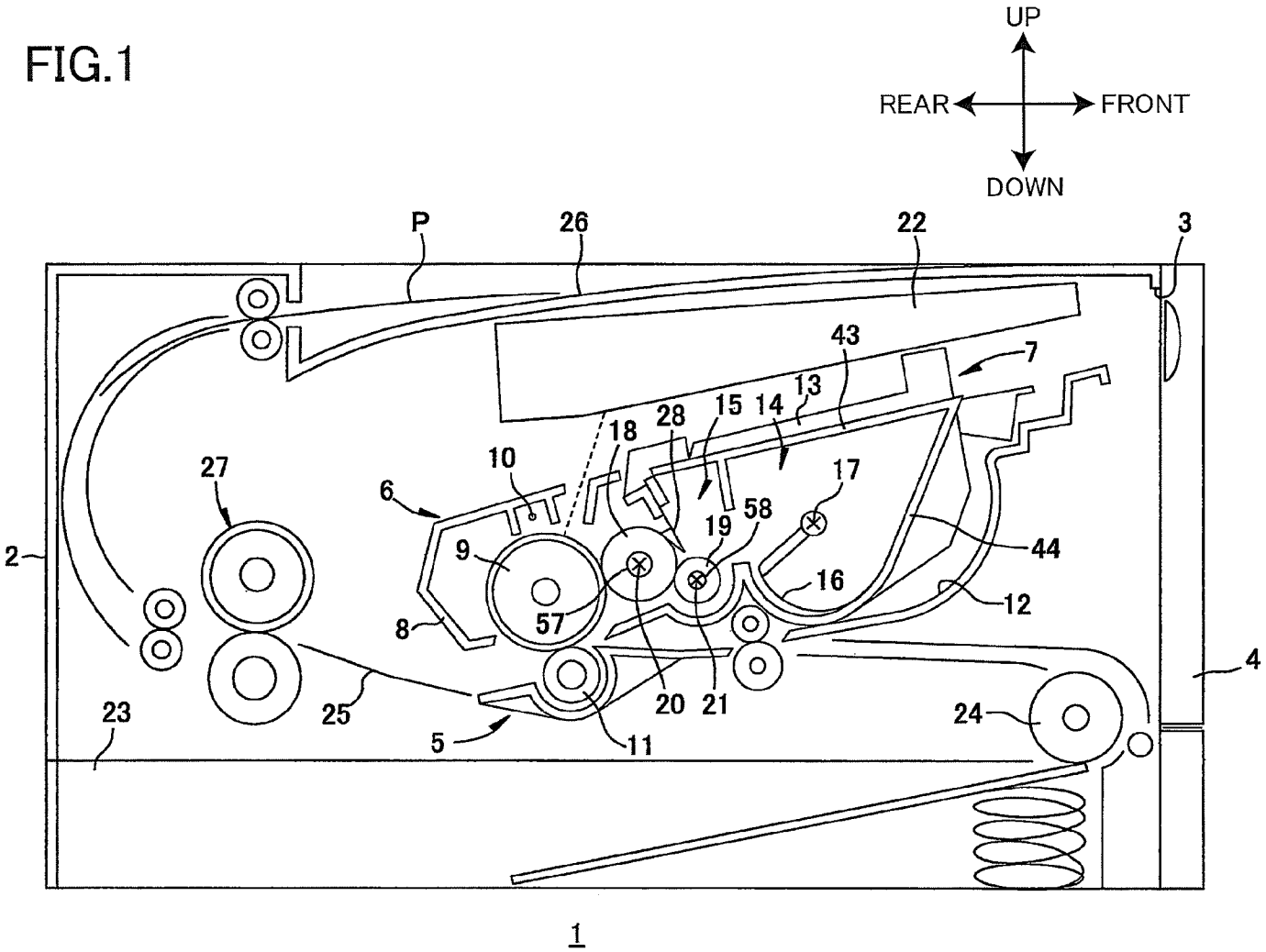
FIG. 1 is a section view of a laser printer mounting a developing cartridge according to an embodiment.

As shown in FIG. 1, a laser printer 1, which is one embodiment of an image forming apparatus, includes a body casing 2 as one embodiment of a body of the apparatus. The body casing 2 has, on its one side wall, an opening 3 for accommodating a cartridge, and a front cover 4 for opening or closing the opening 3.

Meanwhile, to clarify the description below, the side of the casing 2 on which the front cover 4 is fitted is referred to as the front side of the laser printer 1. The geometry (i.e., left, right, up and down) of the laser printer 1 is set from the vantage point looking at the front side of the laser printer 1. Further, the forward or backward direction of a developing cartridge 7, which is explained below, is determined with respect to the body casing 2 mounting the developing cartridge 7, and the other directions (i.e. left, right, up and down) of the developing cartridge 7 is set from the vantage point looking at its front side.

The body casing 2 includes, in its center portion, a developing unit 5 mounted closer to the front side of the laser printer 1. The developing unit 5 may be mounted to, or removed from, the body casing 2 through the opening 3 when the front cover 4 is opened up.

The developing unit 5 includes a drum cartridge 6 and the developing cartridge 7 as an embodiment of a cartridge detachably mounted on the drum cartridge 6.

The drum cartridge 6 includes a drum frame 8. The drum frame 8 includes a photosensitive drum 9 rotatably supported in the rear end portion of the frame 8. An electric charger 10 and a transcription roller 11 are also supported within the drum frame 8. The electric charger 10 and the transcription roller 11 are arranged above and below the photosensitive drum 9, respectively.

The forward portion of the drum frame 8 ahead of the photosensitive drum 9 is formed as a developing cartridge mounting portion 12, in which the developing cartridge 7 is mounted.

The developing cartridge 7 includes a housing 13 for accommodating a developer. The housing 13 includes therein a developer accommodating room 14 as an embodiment of a developer accommodating portion and a developing room 15 adjacently behind the developer accommodating room 14. Both rooms 14 and 15 are in communication.

The developer accommodating room 14 includes an agitator 16, as an embodiment of a rotating member, rotatably supported with respect to an agitator rotation axis line 17 extending from the left to the right of the laser printer 1. The rotation of the agitator 16 makes the developer in the developer accommodating room 14 to be agitated, and then delivered from the developer accommodating room 14 to the developing room 15.

The developing room 15 includes a developing roller 18 and a feed roller 19 rotatably supported with respect to a developing rotation axis line 20 as an embodiment of a fourth axis line and a feed rotation axis line 21, respectively, which extend from the left to the right of the laser printer 1. The developing roller 18 is arranged in such a way that the rear end portion of the housing 13 exposes a portion of the circumferential surface of the developing roller 18. The developing cartridge 7 is mounted in the drum cartridge 6 in a manner that the circumferential surfaces of the developing roller 18 and the photosensitive drum 9 are in contact. The feed roller 19 is arranged at the lower front of the developing roller 18 in a manner that its circumferential surface is in contact with the circumferential surface of the developing roller 18. The feed roller 19 feeds the developer in the developing room 15 onto the circumferential surface of the developing roller 18. A layer thickness regulating blade 28 is provided in the developing room 15. The layer thickness regulating blade 28 is in contact with the developing roller 18 from front side. The toner supplied onto the developing roller 18 is regulated to a thin layer by the layer thickness regulating blade 28 and supported on the surface of the developing roller 18.

Further, the body casing 2 contains an exposure unit 22, which includes (without limitation) laser, above the developing unit 5.

When an image is formed, the photosensitive drum 9 rotates clockwise at a constant rate in FIG. 1. While rotating, the circumferential surface of the photosensitive drum 9 becomes charged uniformly with electricity by discharging of the electric charger 10. Meanwhile, the exposure unit 22 radiates a laser beam based on the image data received from a personal computer (not shown) connected to the laser printer 1. The laser beam passes through between the electric charger 10 and the developing cartridge 7, and irradiates, and thereby exposes selectively, the circumferential surface of the photosensitive drum 9, which has been uniformly positive-charged. This makes electric charges selectively removed from the exposed portion of the circumferential surface of the photosensitive drum 9, and develops an electrostatic latent image on the circumferential surface of the photosensitive drum 9. When the photosensitive drum 9 so rotates as to make the electrostatic latent image face the developing roller 18, the developer is fed from the developing roller 18 onto the electrostatic latent image. The developer image is formed this way onto the circumferential surface of the photosensitive drum 9.

A sheet supply cassette 23 is arranged, at the bottom of the body casing 2, to supply sheets P. A pick-up roller 24 is provided, above the sheet supply cassette 23, to draw sheets out from the sheet supply cassette 23.

Further, a conveying path 25, which is in "S" shape viewed from the side of the laser printer 1, is formed within the body casing 2. The conveying path 25 starts at the sheet supply cassette 23, passes through between the photosensitive drum 9 and the transcription roller 11, and reaches a sheet discharge tray 26 which is formed on the top surface of the body casing 2.

The developer image onto the circumferential surface of the photosensitive drum 9 is electrically attracted, and thereby transcribed, onto a sheet P when the photosensitive drum 9 so rotates as to make the developer image face the sheet P passing through the photosensitive drum 9 and the transcription roller 11.

A photographic fixing unit 27 is provided downstream of the conveying path 26 from the transcription roller 11 in the direction of conveying the sheet P. The sheet P on which the developer image has been transcribed passes through the photographic fixing unit 27 while being conveyed through the conveying path 25. The heat and pressure of the photographic fixing unit 27 fixes the developer image on the sheet P as an image. The sheet P bearing the image this way is further conveyed though the conveying path 25, and discharged on the sheet discharge tray 26.

2. Developing Cartridge (1) Housing

Figure 2:
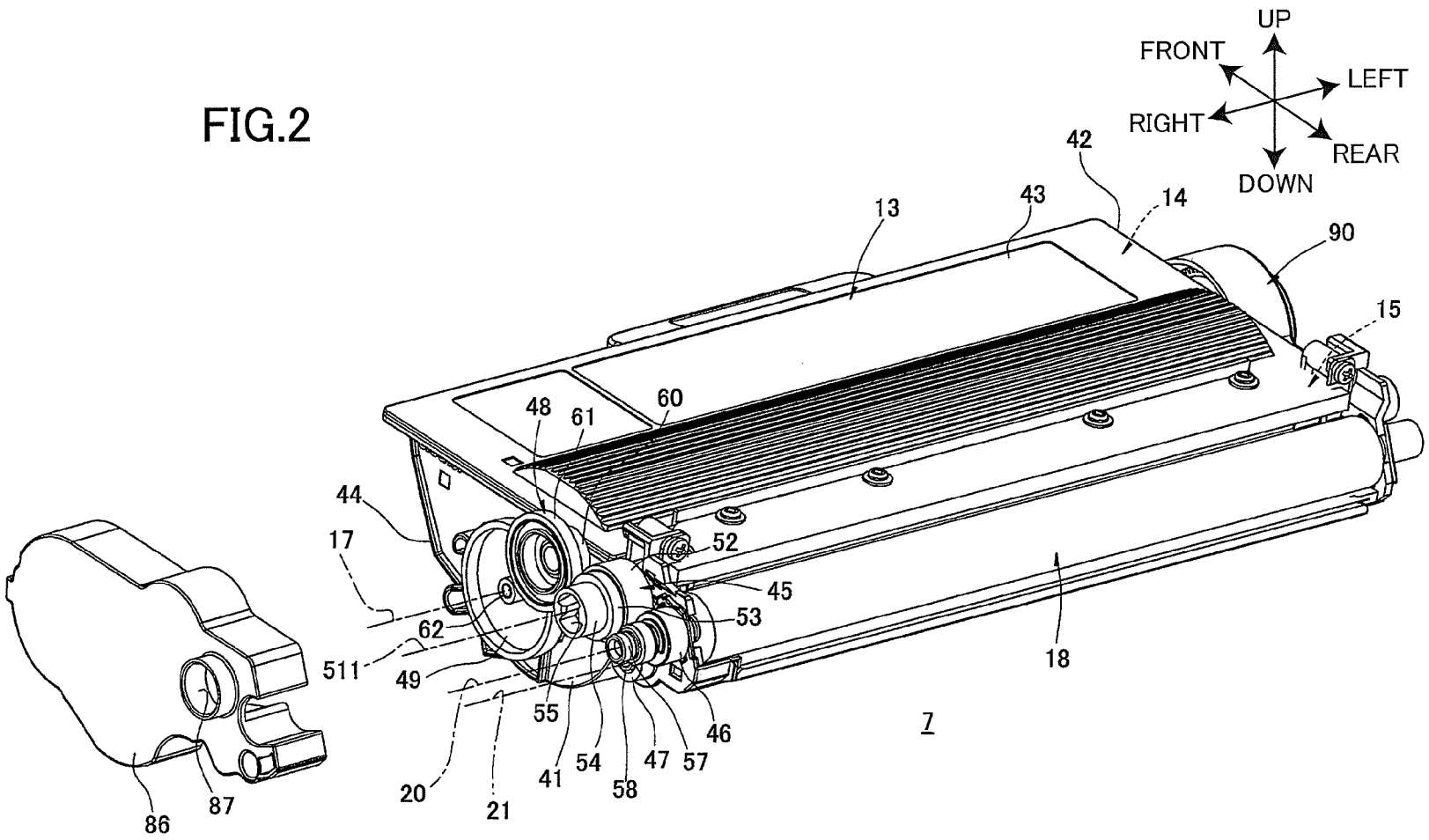
FIG. 2 is a perspective view of the developing cartridge shown in FIG. 1 from the vantage point of the right-rear-top of the cartridge, wherein a driving side gear cover is removed.
Figure 3:
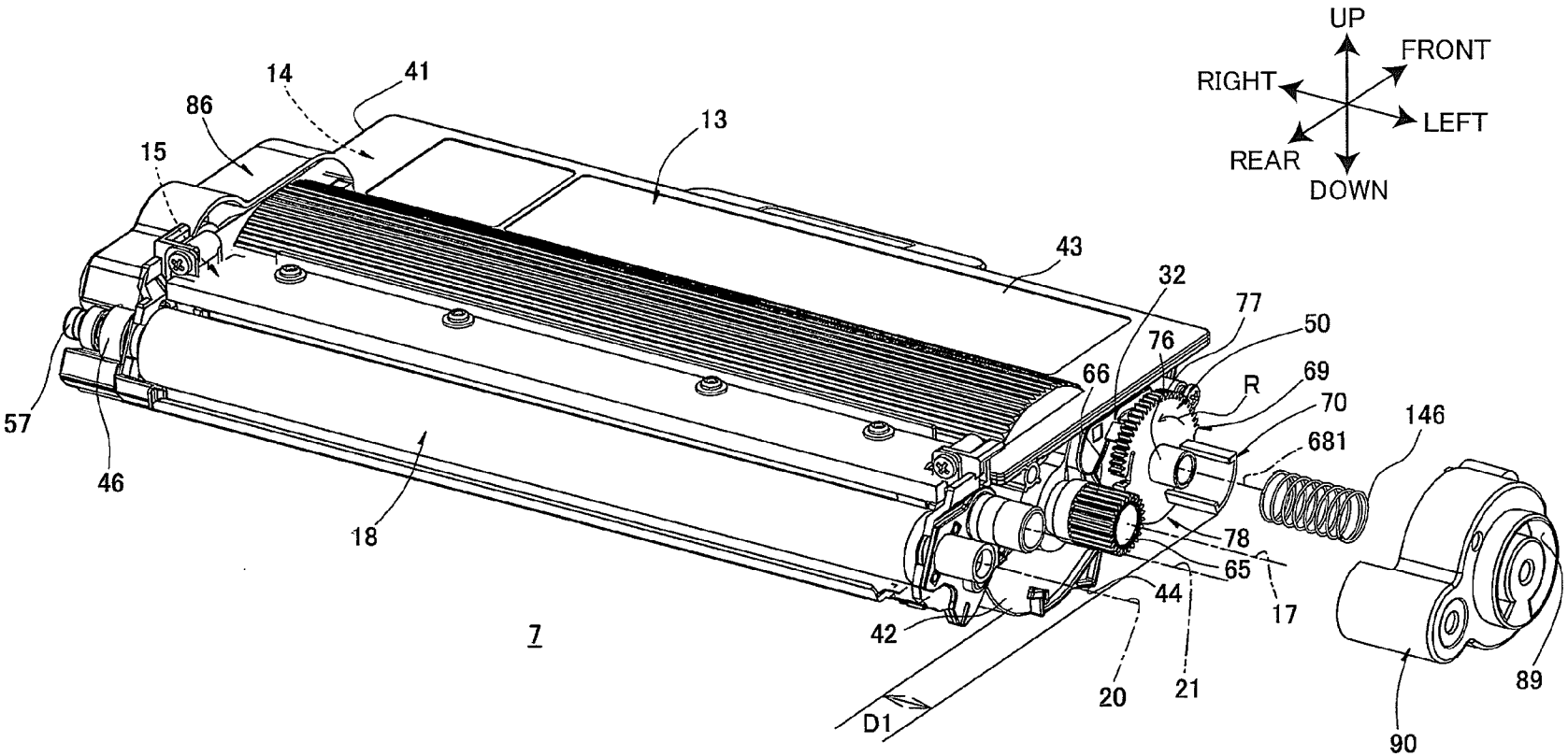
FIG. 3 is a perspective view of the developing cartridge shown in FIG. 2 from the vantage point of the left-rear-top of the cartridge, wherein a detecting side gear cover is removed.

As illustrated in FIGS. 2 and 3, the housing 13 of the developing cartridge 7 is formed as a box shape having its back side open. Specifically, the housing 13 includes a right side wall 41 as an embodiment of a first side wall (see FIG. 3) and a left side wall 42 as an embodiment of a second side wall. The right and left side walls 41 and 42 are configured as plates facing each other in the right-to-left direction, and respectively extending in the front-to-back direction. The developer accommodating room 14 is interposed between the right side wall 41 and the left side wall 42.

Further, the hosing 13 includes an upper side wall 43 built between the upper edges of the right and left side walls 41 and 42, and a lower side wall 44 built between the lower edges of the right and left side walls 41 and 42. The front end portion of the lower side wall 44 extends upward in a curve, and is affixed to the front end portion of the upper side wall 43.

(2) Gear Train

On the left in FIGS. 2 and 3, the outer side (right side) of the right side wall 41 is provided with an input gear 45, a developing gear 46, a feed gear 47, an intermediate gear 48, and a first agitator gear 49, all as an embodiment of a receiving member.

The outer side (left side) of the left side wall 42 is provided with a second agitator gear 65 and a detected rotational body 50 as an embodiment of a detection body.

(2-1) Input Gear

As illustrated in FIG. 2, the input gear 45 is arranged on the upper portion of the rear end of the right side wall 41. The input gear 45 is rotatably supported with respect to a center axis line 511 as an embodiment of a first axis line extending in the right-to-left direction.

Further, the input gear 45 includes, in an integral body, a larger diameter gear part 52, a smaller diameter gear part 53 and a coupling part 54. The larger diameter gear part 52, the smaller diameter gear part 53, and the coupling part 54 are arranged in this order from the right side of the right side wall 41.

The larger diameter gear part 52 has a circular-plate shape coaxially arranged with the center axis line 511. The larger diameter gear part 52 includes gear teeth (e.g., helical gear teeth) around the entire circumferential surface thereof.

The smaller diameter gear part 53 has a circular-plate shape coaxially arranged with the center axis line 511, and has a diameter smaller than the larger diameter gear part 52. The smaller diameter gear part 53 includes gear teeth (e.g., inclined teeth) around the entire circumferential surface thereof.

The coupling part 54 has the shape of a cylindrical column coaxially arranged with the center axis line 511, and includes a circumferential surface of a diameter smaller than that of the smaller diameter gear part 53. The coupling part 54 includes a coupling recess 55 on its right side. When the developing cartridge 7 is mounted in the body casing 2, the front end portion of a driving unit 56 (see FIG. 7) provided within the body casing 2 is inserted into the coupling recess 55.

The driving unit 56 is provided movably in the left or right direction. When the developing cartridge 7 is mounted in the body casing 2, the driving unit 56 inserts its frond end portion into the coupling recess 55 along the center axis line 511 as the driving unit 56 moves to the right. This so connects the driving unit 56 to the coupling recess 55 as not to allow one of them to rotate relatively with respect to the other. Therefore, when operated, the driving unit 56 delivers its rotational force to the input gear 45 as a driving force, and allows the input gear 45 to rotate with the driving unit 56.

(2-2) Developing Gear

The developing gear 46 is arranged at the back of the input gear 45. The developing gear 46 is attached to a developing roller axis 57, which belongs to the developing roller 18, so as not to be relatively rotatable with respect to the axis 57. The developing roller axis 57 is arranged rotatably with respect to the right side wall 41, and has a center axis line playing a role as the developing rotation axis line 20 which is the rotation axis line of the developing roller 18 (See FIG. 1). Gear teeth are formed on the whole circumferential surface of the developing gear 46, and are engaged with the gear teeth of the larger diameter gear part 52 of the input gear 45 from the back thereof.

(2-3) Feed Gear

The feed gear 47 is arranged below the input gear 45. The feed gear 47 is attached to a feed roller axis 58, which belongs to the feed roller 19 (See FIG. 1), so as not to be relatively rotatable with respect to the axis 58. The feed roller axis 58 is arranged rotatably with respect to the right side wall 41, and has a center axis line playing a role as the feed rotation axis line 21 which is the rotation axis line of the feed roller 19 (See FIG. 1). Gear teeth are formed on the whole circumferential surface of the feed gear 47, and are engaged with the gear teeth of the larger diameter gear part 52 of the input gear 45 from below.

(2-4) Intermediate Gear

The intermediate gear 48 is arranged front above the input gear 45 and rotatably supported on the right side wall 41.

Moreover, the intermediate gear 48 includes, as an integral body, a smaller diameter part 60 having a circular-plate shape of relatively a small outer diameter, and a larger diameter part 61 having a cylindrical shape of relatively a large outer diameter. The smaller and larger diameter parts 60 and 61 are arranged in this order from the right side wall 41.

The smaller diameter part 60 includes gear teeth formed around its entire circumferential surface.

The larger diameter part 61 includes gear teeth formed around its entire circumferential surface. The gear teeth of the larger diameter part 61 are engaged with those of the smaller diameter gear part 53 of the input gear 45 from front above.

(2-5) First Agitator Gear

The first agitator gear 49 is arranged front below the intermediate gear 48. The first agitator gear 49 is attached to a right end portion of an agitator rotation axis 62 so as not to be relatively rotatable with respect to the agitator rotation axis 62. The agitator rotation axis 62 passes through the right and left side walls 41 and 42 (See FIG. 1) in the right-to-left direction, and is supported rotatably in the right and left side walls 41 and 42. The agitator 16 is attached to the agitator rotation axis 62 in the housing 13. In this manner, the agitator 16 and the first agitator gear 49 may rotate integrally with the agitator rotation axis 62 with respect to the center axis line of the agitator rotation axis 62, which corresponds to the agitator rotation axis line 17 as an embodiment of a second axis line (See. FIG. 1).

Further, the first agitator gear 49 is in circular-plate shape having a center axis line consistent to that of the agitator rotation axis 62. The first agitator gear 49 includes gear teeth formed on the entire circumferential surface thereof. The gear teeth of the first agitator gear 49 are engaged with the gear teeth of the smaller diameter part 60 of the intermediate gear 48 from front below.

(2-6) Second Agitator Gear

As illustrated in FIG. 3, the second agitator gear 65 is attached to the left end portion of the agitator rotation axis 62 so as not to be relatively rotatable with respect to the agitator rotation axis 62.

The second agitator gear 65 has the shape of a cylindrical column coaxially arranged with the agitator rotation axis 62, and includes gear teeth 66 formed on the entire circumferential surface thereof.

(2-7) Detected Rotational Body

The detected rotational body 50 is arranged in front of the second agitator gear 65. The detected rotational body 50 is provided rotatably with respect to a center axis line 681, which is an embodiment of the third axis line, of a rotation axis 68 extending in the right-to-left direction. The detected rotational body 50 is provided reciprocable along the center axis line 681.

Figure 6:
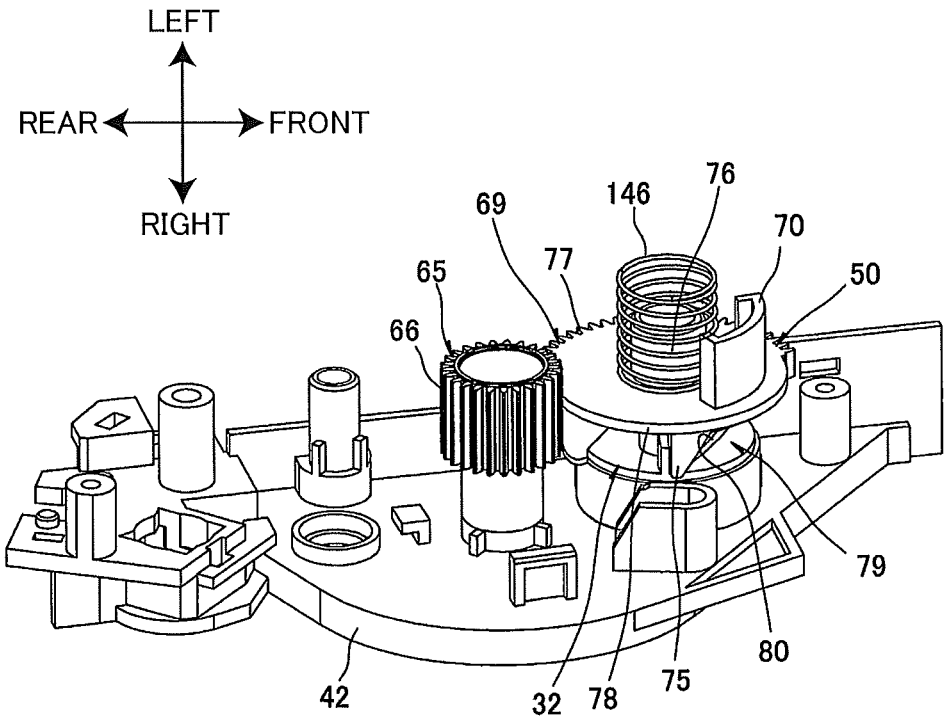
FIG. 6 is a perspective view of a left side wall of the developing cartridge at the state shown in FIG. 5 from the vantage point of the left-rear of the cartridge.

Further, the detected rotational body 50 includes, as an integral body, a toothless gear part 69, a detected part 70, and a supporting part 75 as an embodiment of a contact part (See FIG. 6).

The toothless gear part 69 is configured in a circular plate shape having a central axis coaxial with the center axis line 681 of the rotation axis 68. The left end surface (outer surface) of the toothless gear part 69 includes a cylindrical insert-penetrating boss 76 projecting therefrom. The rotation axis 68 is inserted into, and passes through, the cylindrical insert-penetrating boss 76 so as to be relatively rotatable and movable in the right-to-left direction.

The toothless gear part 69 includes gear tooth 77 (operating part) formed on a portion of the circumferential surface of the toothless gear part 69. Specifically, the toothless gear part 69 includes the toothless portion 78 (non-operating part) having a central angle of about 180 degrees around the circumferential surface of the toothless gear part 69, and includes gear teeth 77 formed on the remaining portion (other than the toothless portion 78) of the circumferential surface, which amounts to a central angle of about 180 degrees. The gear teeth 77 engages with the second agitator gear 65 in response to the rotational position of the detected rotational body 50. Moreover, the width (measure in the right-to-left direction) of the toothless gear part 69 is less than the measure in the right-to-left direction of the second agitator gear 65. Both measures and arrangements are so designed that, when the gear teeth 66 and 77 are in engagement, the movement of the toothless gear part 69 in the right-to-left direction does not release such engagement.

The detected part 70 projects from the left side surface of the toothless gear part 69. The detected part 70 is arranged on the line connecting the center axis line 681 of the rotation axis 68 and the gear tooth 77 located uppermost in a rotational direction R as an embodiment of a first direction (clockwise in FIG. 5) of the detected rotational body 50. The detected part 70 is formed in a circular arc rib shape extending in the rotational direction R around the center axis line 681.

The supporting part 75 projects from the right side surface (inner surface) of the toothless gear part 69 as illustrated in FIG. 6. The supporting part 75 extends both in the right-to-left direction and in the direction of the diameter of the toothless gear part 69.

(3) Sliding Part

Figure 4:
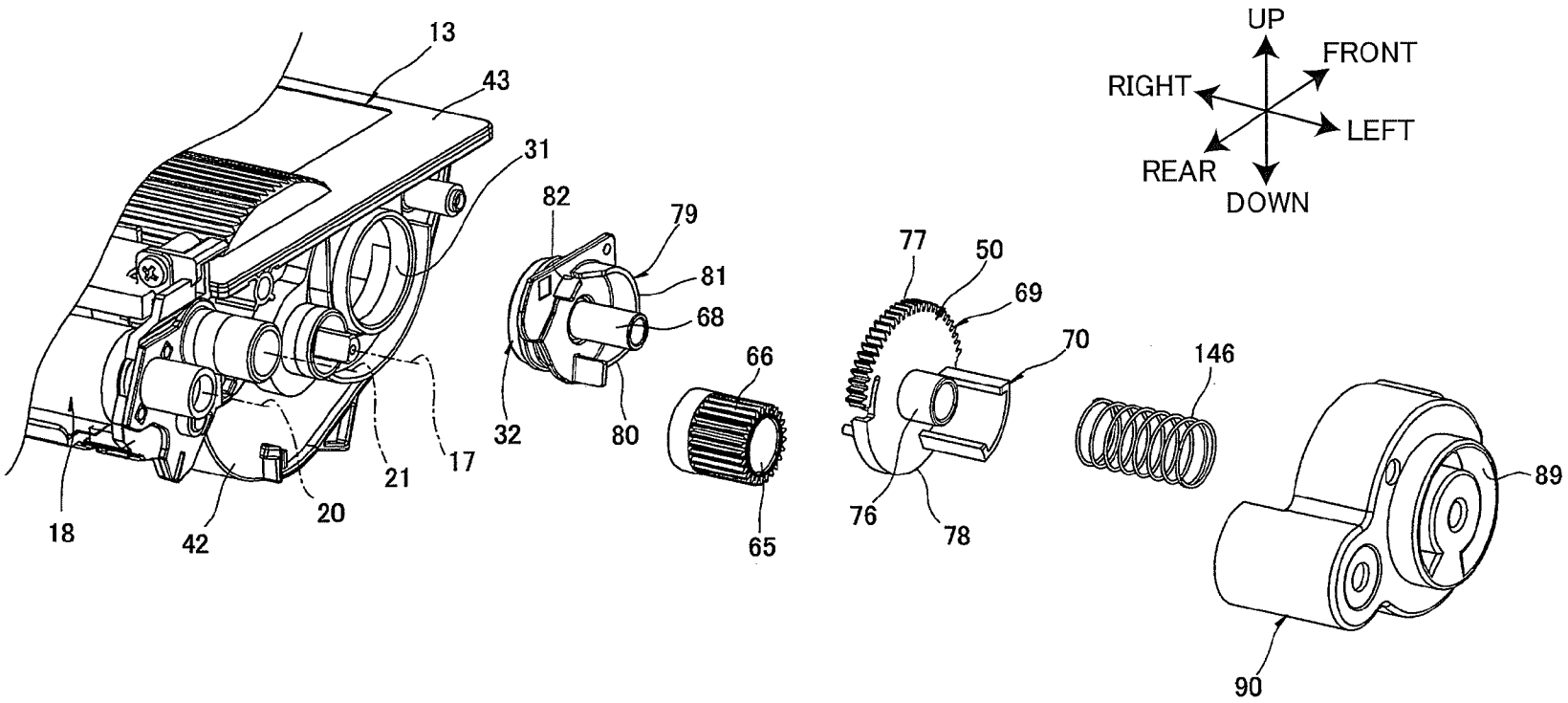
FIG. 4 is an exploded perspective view of the developing cartridge shown in FIG. 3 from the vantage point of the left-rear of the cartridge.

On the outer surface of the left side wall 42, as shown in FIG. 4, a sliding part 79 is provided at a portion formed between the left side wall 42 and the detected rotational body 50. The sliding part 79 projects from a left side surface of a toner cap 32 blocking a toner filling hole 31 of the developing cartridge 7, and, as viewed from the side surface, has the three quarter cylindrical shape of a rib around the rotation axis 68.

Further, the height of the sliding part 79 from the left side surface of the toner cap 32 is the smallest at a portion below the rotation axis 68, increases gradually from that portion to a portion ahead of the rotation axis 68, and remains constant over the remainder of the sliding part 79. Therefore, over the portion where the height gradually increases, the left end surface of the sliding part 79 includes an inclined surface 80 so tilted as to be more apart from the left side surface of the toner cap 32 as it goes downstream of the rotational direction R of the detected rotational body 50. The left end surface of the sliding part 79 includes, downstream from the inclined surface 80 in the rotational direction R, a parallel surface 81 running parallel to the left side surface (the left side wall 42) of the toner cap 32 and extending continuously from the inclined surface 80 in the rotational direction.

The sliding part 79 includes a notch portion 82 formed in a rectangular shape cut toward the left side surface of the toner cap 32 from the end portion of the parallel surface 81 downstream in the rotational direction R.

(4) Driving Side Gear Cover

Moreover, as illustrated in FIG. 2, a driving side gear cover 86 is attached to the outer side of the right side wall 41. The driving side gear cover 86 covers all together the input gear 45, the feed gear 47, the intermediate gear 48, and the first agitator gear 49. On the driving side gear cover 86 is an opening 87 formed for exposing the coupling part 54 of the input gear 45.

(5) Detecting Side Gear Cover

As illustrated in FIG. 3, a detecting side gear cover 90 as an embodiment of a cover is attached to the outer side of the left side wall 42. The detecting side gear cover 90 covers all together the second agitator gear 65 and the detected rotational body 50. The detecting side gear cover 90 is formed with a C-shaped opening 89 exposing the detected part 70 leftward at a position in confrontation with the detected part 70 of the detected rotational body 50.

A coil spring 146 as an embodiment of a pressing member is provided between the toothless gear part 69 of the detected rotational body 50 and the inner surface of the detecting side gear cover 90 so as to fit onto the insert-penetrating boss 76. Hence, the insert-penetrating boss 76 is inserted into the coil spring 146. The detected rotational body 50 is pressed toward the left side wall 42 by the pressing force (resilient force) of the coil spring 146.

3. Detecting Device

Figure 5:
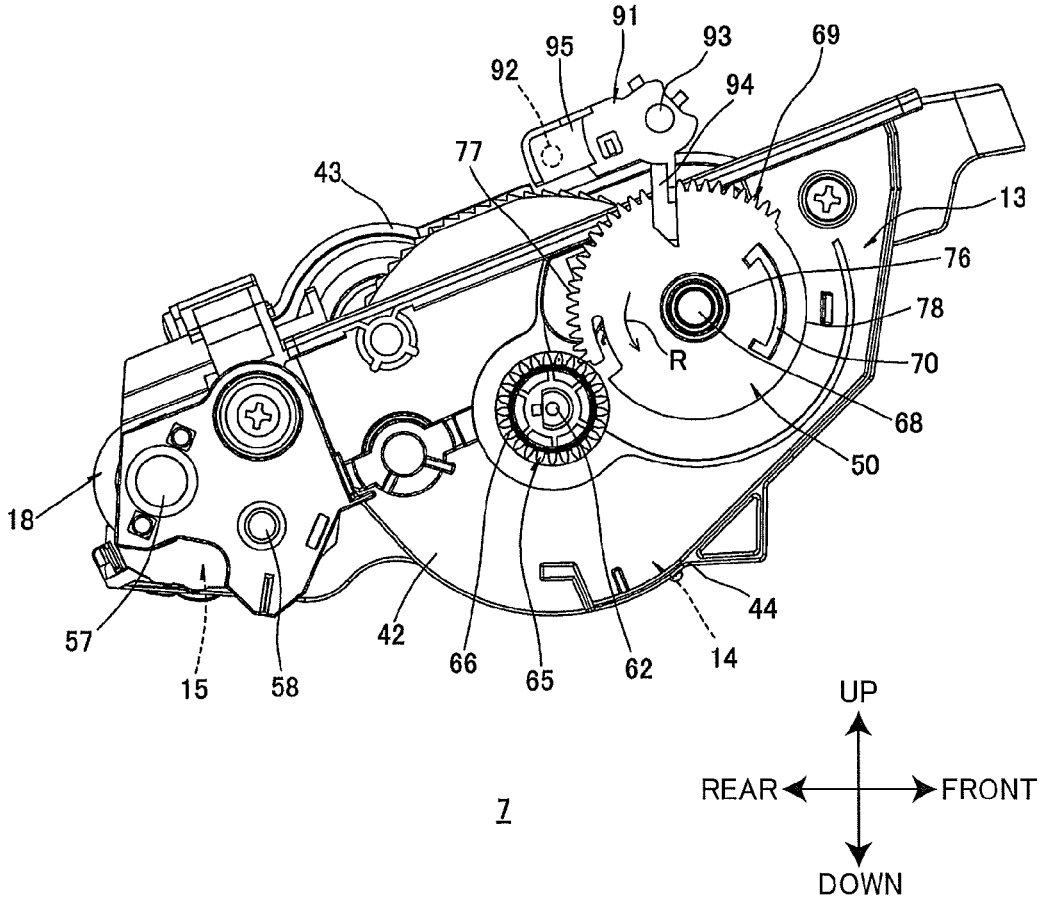
FIG. 5 is a left side view of the developing cartridge shown in FIG. 3.

The body casing 2 is provided therein with a detecting device for tracking the detected part 70, as illustrated in FIG. 5. The detecting device includes an actuator 91 and a light sensor 92 as an embodiment of a measuring unit.

The actuator 91 includes a swinging axis 93 extending in the right-to-left direction, a contact lever 94 extending downward from the swinging axis 93, and a light shielding lever 95 extending backward from the swinging axis 93, as an integral body. The swinging axis 93 is rotatably supported, for example, in an inner wall (not shown) of the body casing 2. The contact lever 94 and the light shielding lever 95 forms an angle of about 80 degrees around the swinging axis 93.

Figure 10:
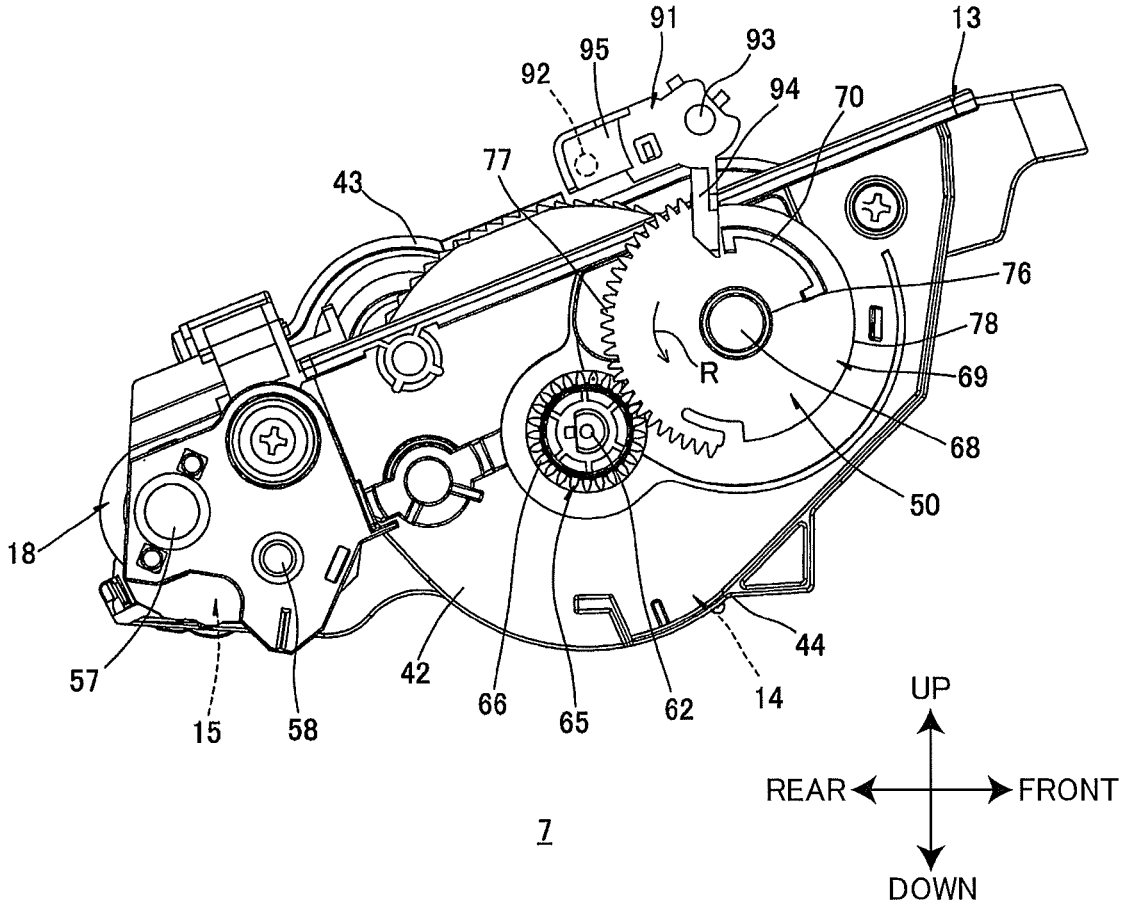
FIG. 10 is a left side view of the developing cartridge at the state shown in FIG. 8.
Figure 11:
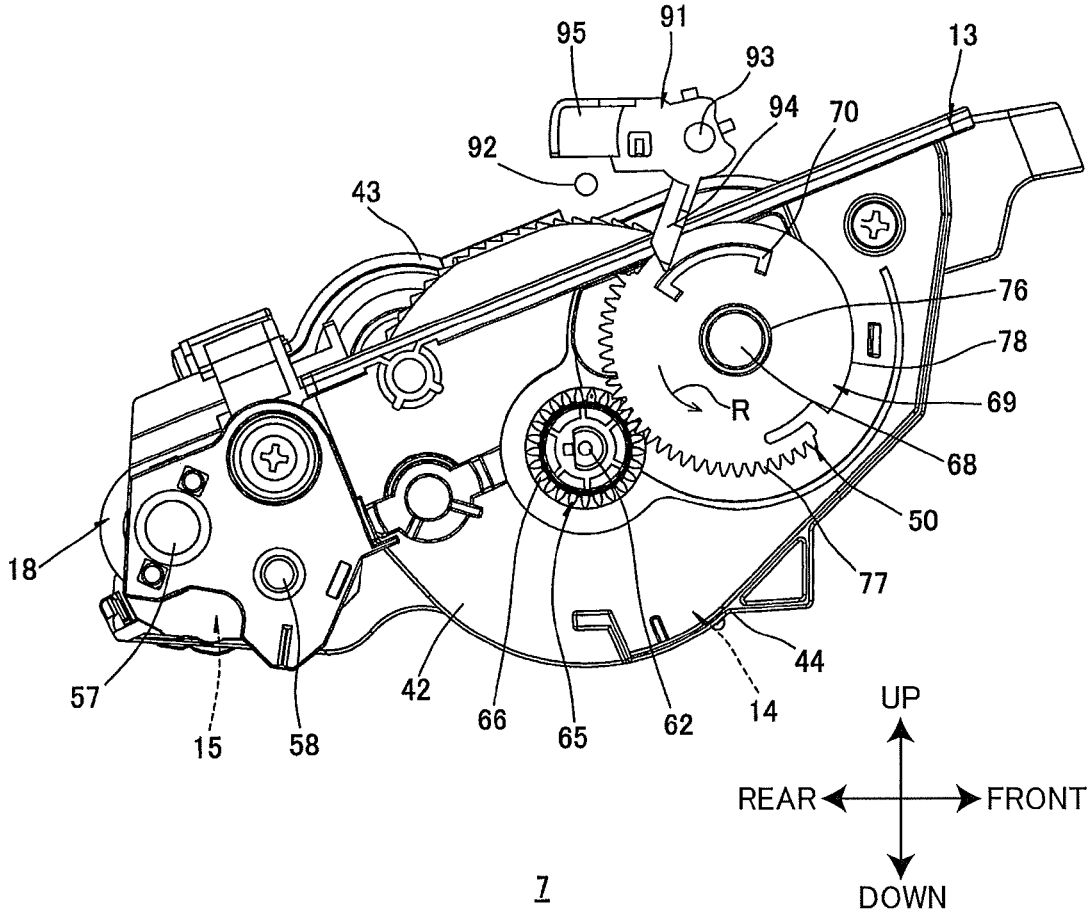
FIG. 11 is a left side view of the developing cartridge, with the detected rotational body rotated further from the position shown in FIG. 10.

The actuator 91 is so provided as to swing between a non-measuring position, in which, as illustrated in FIGS. 5 and 10, the contact lever 94 extends almost vertically downwards from the swinging axis 93, and the light shielding lever 95 extends substantially inclined both in the backward direction and in the downward direction, and a measuring position, in which, as illustrated in FIG. 11, the contact lever 94 extends substantially inclined both in the backward direction and in the downward direction, and the light shielding lever 95 extends backwards. The spring force of a spring (not shown) presses the actuator 91 to the non-measuring position absent other external forces.

The light sensor 92 includes a light emitting element and a light receiving element, both of which face each other in the right-to-left direction. The light sensor 92 is arranged in a position where a light path from the light emitting element to the light receiving element is shielded by the light shielding level 95 of the actuator 91 in the non-measuring position, and the light shielding lever 95 is retracted from the light path in the measuring position. In other words, the light shielding lever 95 is in the light path from the light emitting element to the light receiving element when the actuator 91 is in the measuring position, and the light shielding lever 95 is retracted from the light path when the actuator 91 is in the non-measuring position. When the light shielding lever 95 is retracted from (relieved of) the light path from the light emitting element to the light receiving element, the detecting light from the light emitting element is received on the right receiving element and the light sensor 92 outputs an on-signal.

4. Detecting for Installation of Developing Cartridge and for New Cartridge

As shown in FIGS. 3, 5, and 6, the detected part 70 of the detected rotational body 50 is arranged, within a new developing cartridge 7, in the lower forward direction with respect to the rotation axis 68. The left end of the detected part 70 is located substantially flush with the left end surface of the detecting side gear cover 90.

A lowermost portion of gear teeth 77 of the detected rotational body 50 downstream in the rotational direction R is engaged with the gear teeth 66 of the second agitator gear 65. The coil spring 146 presses the toothless gear part 69 against the left side wall 42, being in contact with the left end surface of the toothless gear part 69 of the detected rotational body 50.

Further, the supporting part 75 of the detected rotational body 50 is in contact with a portion of the left end surface of the sliding part 79 upstream beyond the inclined surface 80 in the rotational direction R.

Meanwhile, the right-to-left position of the detected rotational body 50 at this moment corresponds to an embodiment of a first position as an initial position. Moreover, the distance D1 (See FIG. 3) between the left end of the detected part 70 and the left side wall 42 in the right-to-left direction is an embodiment of a first distance.

Figure 7:
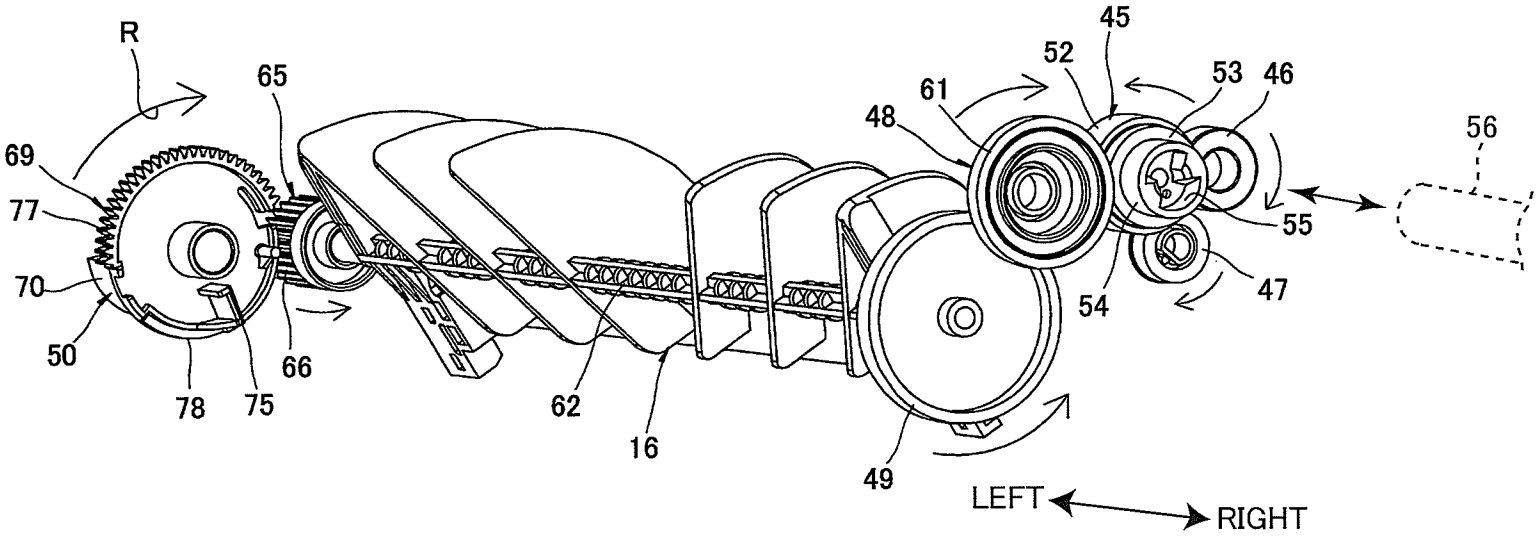
FIG. 7 is an explanatory diagram for a driving force transmission of the developing cartridge shown in FIG. 2.

When the developing cartridge 7 is attached to the body casing 2, a warm-up operation of the laser printer 1 is performed. In the warm-up operation, as illustrated in FIG. 7, the driving unit 56 is inserted into the coupling recess 55 of the input gear 45, and the driving force is delivered from the driving unit 56 to the input gear 45, thereby rotating the input gear 45. In connection with the rotation of the input gear 45, the developing gear 46, the feed gear 47, and the intermediate gear 48 rotate, and the developing roller 18 and the feed roller 19 rotate. Accompanying the rotation of the intermediate gear 48, the first agitator gear 49 rotates. The rotation of the agitator 16 stirs up the developer contained in the developing cartridge 7.

Further, accompanying the rotation of the first agitator gear 49, the second agitator gear 65 rotates through the agitator rotation axis 62. In a new developing cartridge 7, the gear teeth 66 of the second agitator gear 65 are engaged with the gear teeth 77 of the detected rotational body 50. Thus, when the second agitator gear 65 rotates, the detected rotational body 50 rotates in the rotational direction R subject to the rotation of the second agitator gear 65.

As illustrated in FIG. 5, the detected part 70 is not in contact with the contact lever 94 of the actuator 91, immediately after the new developing cartridge 8 is attached to the body casing 2. Further, the actuator 91 is in the non-measuring position, and the contact lever 94 faces the opening 89 of the detecting side gear cover 90 in the right-to-left direction, and the light path of the light sensor 92 is shielded by the light shielding lever 95. Accordingly, the light sensor 92 outputs an off-signal.

Figure 8:
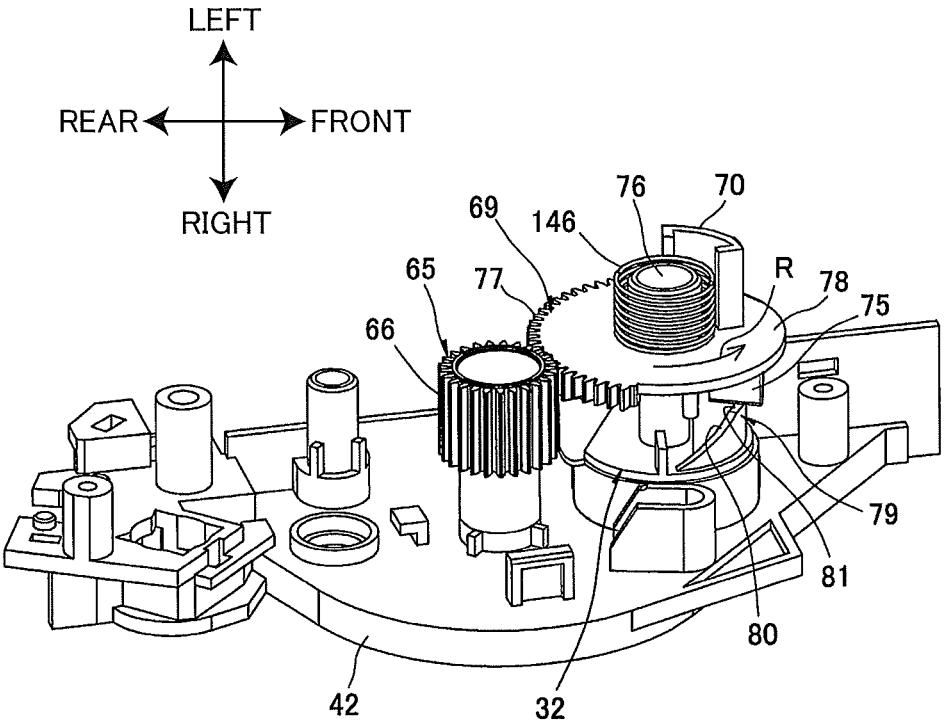
FIG. 8 is a perspective view of the left side wall of the developing cartridge from the vantage point of the left-bottom of the cartridge, with the detected rotational body rotated further from the position shown in FIG. 6.

As illustrated in FIG. 8, the rotation of the detected rotational body 50 moves the detected part 70 so as to close to the contact lever 94. At the same time, the supporting part 75 of the detected rotational body 50 slides toward the inclined surface 80 along the left end surface of the sliding part 79, and consecutively slides toward the parallel surface 81 along the inclined surface 80. Such rotation causes the detected rotational body 50 to move gradually in the left direction.

Figure 9:
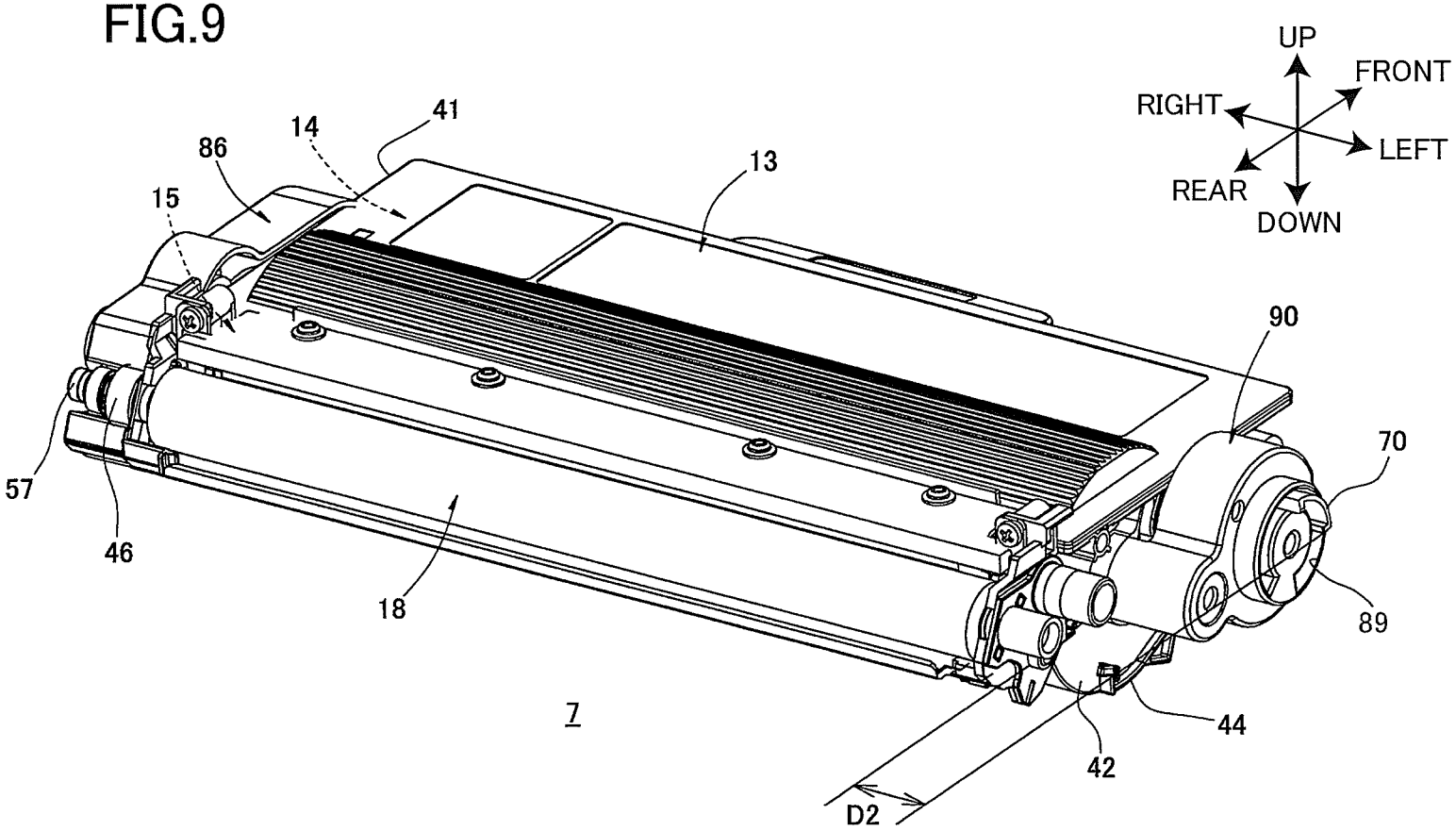
FIG. 9 is a perspective view of the developing cartridge at the state shown in FIG. 8 from the vantage point of the left-rear-top of the cartridge.

Consequently, as illustrated in FIG. 9, the detected part 70 advances gradually in the left direction as they move in the rotational direction R, and the front ends thereof projects through the opening 89 of the detecting side gear cover 90.

Then, when the supporting part 75 of the detected rotational body 50 moves from the inclined surface 80 onto the parallel surface 81, the distance D2 between the left end of the detected part 70 and the left side wall 42 in the right-to-left direction becomes the maximum.

Meanwhile, the position of the detected rotational body 50 in the right-to-left direction is an embodiment of a second position. Further, the maximum distance D2 (See FIG. 9) at this moment is an embodiment of a second distance.

As illustrated in FIG. 10, one end of the detected part 70 faces the front side of the contact lever 94. Subsequently, when the detected rotational body 50 rotates, the detected part 70 is in contact with the contact lever 94.

As the detected rotational body 50 rotates further, the detected part 70 presses the contact lever 94 backward as illustrated in FIG. 11, thereby setting the actuator 91 from the non-measuring position to the measuring position. Therefore, the light shielding lever 95 is relieved of the light path from the light emitting element to the light receiving element of the light sensor 92, and, thus, the light sensor 92 outputs an on-signal. Accordingly, the detected part 70 may be indirectly detected by the light sensor 92.

Since the light sensor 92 maintains the measuring position while the detected part 70 passes the lower side of the actuator 91, the light sensor 92 outputs the on-signal continuously.

Figure 12:
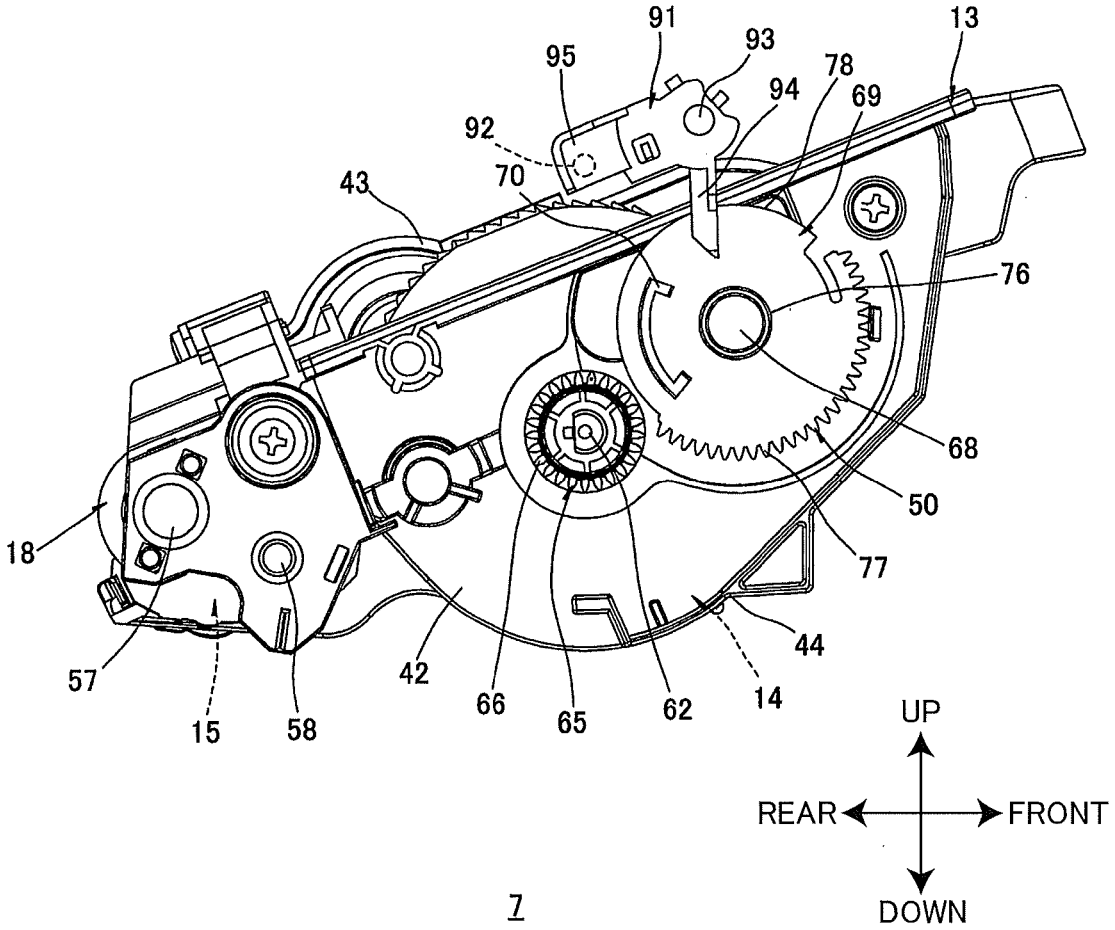
FIG. 12 is a left side view of the developing cartridge, with the detected rotational body rotated further from the position shown in FIG. 11 and a gear teeth of a detected rotational body disengaged with a gear teeth of a second agitator gear.

Then, as the rotation of the detected rotational body 50 advances further, the detected part 70 moves away from the contact lever 94, and the actuator returns from the measuring position to the non-measuring position as illustrated in FIG. 12. Consequently, the light path from the light emitting element to the light receiving element of the light sensor 92 is shielded by the light shielding lever 95, and the output signal from the light sensor 92 is changed from an on-signal to an off-signal.

Furthermore, when the supporting part 75 slides further on the parallel surface 81, and then faces the notch portion 82, in response to the additional rotation of the detected rotational body 50, the supporting part 75 fits into the notch portion 82 by the pressing force of the coil spring 146.

Figure 13:
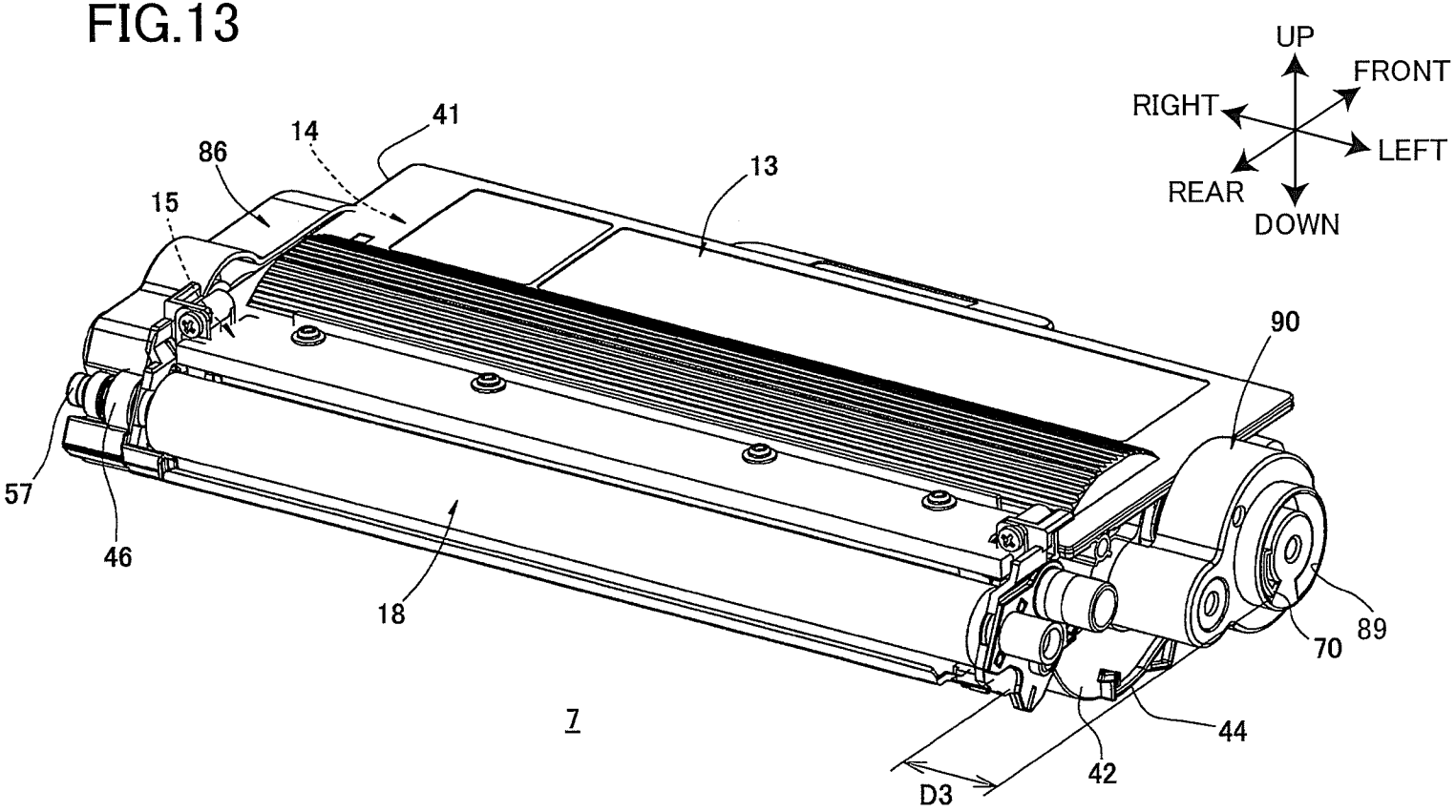
FIG. 13 is a perspective view of the developing cartridge at the state shown in FIG. 11 from the vantage point of the left-rear-top of the cartridge.

Accordingly, as shown in FIG. 13, the detected part 70 is retracted to the right, and the front end thereof is arranged substantially flush with the left end surface of the detecting side gear cover 90. At the same time, the gear teeth 77 of the detected rotational body 50 is disengaged with the gear teeth 66 of the second agitator gear 65, and the rotation of the detected rotational body 50 ceases.

Meanwhile, the position of the detected rotational body 50 in the right-to-left direction at this moment is an embodiment of a third position. Moreover, the distance D3 between the left end of the detected part 70 and the left side wall 42 in the right-to-left direction at this moment is an embodiment of a third distance, which is identical to the distance D1 in the embodiment described herein.

As such, when a new developing cartridge 7 is first attached to the body casing 2, on-signal is outputted once from the light sensor 92. Therefore, when a developing cartridge 7 is attached to the body casing 2, the developing cartridge 7 may be determined as a brand-new cartridge if the light sensor 92 generates one on-signal.

On the other hands, when a used developing cartridge 7 (a developing cartridge 7 that has ever been attached to the body casing 2) is attached to the body casing 2, the detected rotational body 50 does not rotate, even after a warm-up operation of the laser printer 1 begins, because the detected rotational body 50 is in a rotational position where the gear teeth 77 is disengaged with the gear teeth 66. Thus, if an on-signal is not outputted from the light sensor for a particular period of time after a developing cartridge 7 is attached to the body casing 2, the developing cartridge 7 may be determined as an used cartridge In the meantime, a plurality of detected parts 70 may be provided. If the plurality of detected parts 70 is provided on the developing cartridge 7, the light sensor 92 generates at least two signals when a new developing cartridge 7 is attached to the body casing 2. Therefore, the developing cartridge 7 can be determined as a brand-new cartridge if the light sensor 92 generates at least two on-signals.

For example, while the developing cartridge 7 with two detected parts 70 may accommodate a relatively larger amount of a developer in the housing 13, the developing cartridge 7 with a single detected part 70 may accommodate a relatively smaller amount of a developer in the housing 13. If those new cartridges 7 are selectively attached to the body casing 2, the kind of a new attached developing cartridge 7 are distinguishable based on the number of on-signals or the output time output from the light sensor 92.

5. Technical Effects (1) According to the developing cartridge 7, as illustrated in FIGS. 2 and 3, the input gear 45 is provided on the right side wall 41, while the detected rotational body 50 is provided on the left side wall 42. The driving force inputted to the input gear 45 is transmitted to the detected rotational body 50 through the agitator 16.

Hence, since the input gear 45 and the detected rotational body 50 are provided different walls, the areas of the right and left side walls 41 and 42 can be reduced. Therefore, the size of the developing cartridge 7 can be reduced. Further, the size of the laser printer 1 can be reduced.

Further, since the driving force is transmitted from the input gear 45 to the detected rotational body 50 by using the agitator 16, the number of parts for the developing cartridge 7 can be reduced.

As illustrated in FIGS. 3, 9, and 13, by the driving force transmitted from the input gear 45 to the detected rotational body 50 through the agitator gear 16, the detected rotational body 50 is moved leftward from the left side wall 42 while rotating and after that the detected rotational body 50 is retracted rightward (toward the left side wall 42).

Therefore, when the detected rotational body 50 is moved to the outmost position (see FIG. 9), the detected rotational body 50 can be easily detected by the light sensor 92 in the body casing 2. Further, when the detected rotational body 50 is retracted inward (the detected part 70 is not projected from the detecting side gear cover 9), the detected part 70 can be avoided from the damages caused by a collision with other members.

(2) According to the developing cartridge 7, as illustrated in FIGS. 3, 9, and 13, the detected rotational body 50 moves from the first position that is the position where the detected part 70 is apart from the left side wall 42 at the distance D1 in the right-to-left direction (see FIG. 3), via the second position where the distance in the moving direction between the detected part 70 and the left side wall 42 is the distance D2 larger than the distance D1 (see FIG. 9), to the third position where the distance in the moving direction between the detected part 70 and the left side wall 42 is the distance D3 smaller than the distance D2 (see FIG. 13).

Hence, when the detected rotational body 50 is in the second position (see FIG. 9), the detected rotational body 50 can be easily detected by the light sensor 92 in the body casing 2. Further, when the detected rotational body 50 is in the first position (see FIG. 3) or the third position (see FIG. 13), the detected part 70 can be avoided from the damages caused by a collision with other members.

(3) According to the developing cartridge 7, as illustrated in FIGS. 3 and 13, the distance D1 is identical to the distance D3.

When the detected rotational body 50 is retracted into the third position, the detected rotational body 50 can be retracted at the same position as the first position.

Therefore, since the size of the developing cartridge 7 is not changed between when the detected rotational body 50 is in the first position and when the detected rotational body 50 is in the third position, the size of the developing cartridge 7 can be reduced.

(4) According to the developing cartridge 7, as illustrated in FIGS. 6 and 8, by sliding the supporting part 75 on the inclined surface 80 of the sliding part 79 of the left side surface 42, the detected rotational body 50 is moved to the second position along the center axis line 681 while separating from the left side surface 42 with rotating in the rotational direction R.

Since the rotational movement of the detected rotational body 50 is transformed the movement of the detected rotational body 50 in the center axis line 681 by the inclined surface 80 of the sliding part 79, the detected rotational body 50 can be moved from the first position to the second position certainly.

(5) According to the developing cartridge 7, as illustrated in FIG. 4, the sliding part 79 includes the parallel surface 81 formed continuously from the downstream portion of the inclined surface 80 in the rotational direction R and extending parallel to the left side wall 42.

Hence, the detected rotational body 50 can be maintained in the second position while the detected rotational body 50 is in contact with the parallel surface 81.

(6) According to the developing cartridge 7, as illustrated in FIG. 7, the detected rotational body 50 includes its circumferential surface around the center axis line 681. The toothless portion 78 is formed on a portion of the circumferential surface, and the gear teeth 77 are formed on the remaining portion (other than the toothless portion 78) of the circumferential surface. The gear teeth 77 are engaged with the second agitator gear 65 of the agitator 16 while the detected rotational body 50 is moved from the first position to the third position.

Therefore, the driving force from the agitator gear 16 can be transmitted to the detected rotational body 50 through the second agitator gear 65 when the detected rotational body 50 is moved from the first position to the third position.

When the detected rotational body 50 moves to the third position, the toothless portion 78 of the detected rotational body 50 faces the second agitator gear 65 and the gear teeth 77 of the detected rotational body 50 are disengaged with the gear teeth 66 of the second agitator gear 65.

Therefore, when the detected rotational body 50 moves to the third position, the detected rotational body 50 can maintain its idle state regardless of the rotation of the second agitator gear 65.

(7) According to the developing cartridge 7, as illustrated in FIG. 3, the coil spring 146 is provided for pressing the detected rotational body 50 toward the left side surface 42.

With this structure, the detected rotational body 50 can be pressed against the left side wall 42 by such a simple structure by using the coil spring 146, and the detected rotational body 50 can assuredly be moved from the second position to the third position.

Therefore, the detected rotational body 50 can be moved from the second position to the third position certainly.

(8) According to the developing cartridge 7, as illustrated in FIGS. 3, 9, and 13, the detecting side gear cover 90 is provided for covering the detected rotational body 50. The detected rotational body 50 is positioned in the detecting side gear cover 90 when the detected rotational body 50 is in the first position or the third position, and the detected part 70 is exposed out of the detecting side gear cover 90 through the opening 89 when the detected rotational body 50 is in the second position.

Therefore, since the detected rotational body 50 can be covered by the detecting side gear cover 90, the detected part 70 can be avoided from the damages caused by a collision with other members.

Further, when the detected rotational body 50 is in the second position, the detected rotational body 50 can be detected by the light sensor 92 in the casing body 2 certainly.

6. Other Embodiments

(1) Modified Embodiment 1

In the configuration of the embodiment explained above, the detected rotational body 50 is urged toward the left side surface 42 by the coil spring 146.

Figure 14:
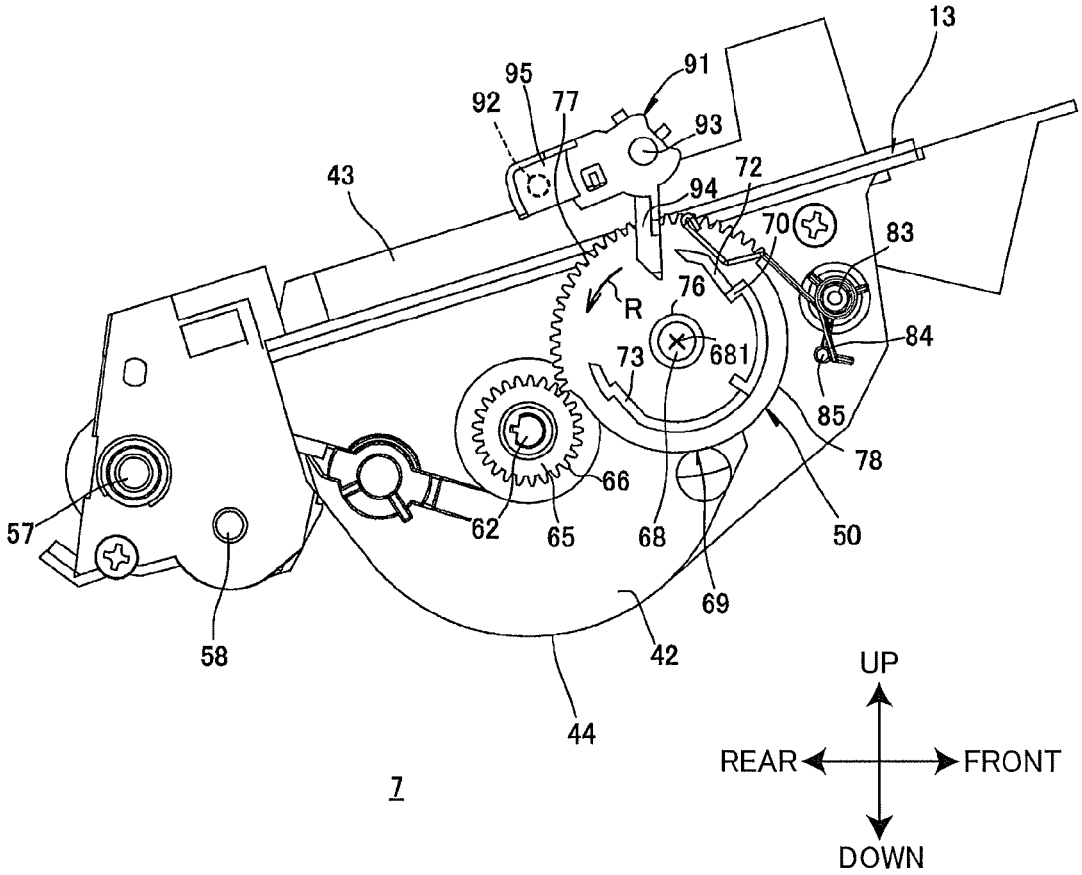
FIG. 14 is a left side view of the developing cartridge according to a modified embodiment 1.

However, as illustrated in FIG. 14, the detected rotational body 50 may be urged toward the left side surface 42 by a wire spring 84.

For details, the detected rotational body 50 includes first pressed part 72 and a second pressed part 73 that extend from the detected part 70.

The first pressed part 72, as viewed from the side surface, extends from the detected part 70 in a straight line toward the downstream of the rotational direction R of the detected rotational body 50. The front end portion of the first pressed part 72 is obliquely bent in shape toward the center axis line 681 from the straight portion of the first pressed part 72.

The second pressed part 73 is located with a rotational symmetry of 180 degrees with respect to the first pressed part 72 around the center axis line 681. The second pressed part 73, as viewed from the side surface, has a straight portion extending parallel to the straight portion of the first pressed part 72.

A boss 83 as a projection portion having the shape of a cylindrical column projects from the outer surface of the left side wall 42 in the forward direction of the detected rotational body 50. Around the boss 83 is the wire spring 84 coiled as an embodiment of a pressing member. An end portion of the wire spring 84 extends toward the outer side of the toothless gear part 69 of the detected rotational body 50. The middle part of that end portion is bent in a cranked shape, and the front end part of the end portion is in contact with the left side surface of the toothless gear part 69. A cylindrical boss 85 also projects from the outer surface of the left side wall 42 below the boss 83. The other end of the wire spring 84 is coupled with the front side of the boss 85.

When the detected rotational body 50 is in the first position (see FIG. 3), the wire spring 84 presses the toothless gear part 69 against the left side wall 42, being in contact with the left end surface of the toothless gear part 69 of the detected rotational body 50. The wire spring 84 also presses the first pressed part 72 backwards, being in contact with the front side of the first pressed part 72.

When the detected rotational body 50 is in the third position, the wire spring 84 presses the toothless gear part 69 against the left side wall 42, being in contact with the left end surface of the toothless gear part 69 of the detected rotational body 50. Simultaneously, the wire spring 84 presses the second pressed part 73 having a pressed surface backward (in the rotational direction R), being in contact with the front side of the second pressed part 73.

As a result, the rotational position of the detected rotational body 50 remains in the same rotational position where the gear teeth 77 is disengaged with the gear teeth 66, and the detected rotational body 50 stays idle regardless of the rotation of the second agitator gear 65.

In the modified embodiment 1, the effect the same as that of the above embodiment can be achieved.

(2) Modified Embodiment 2

In the configuration of the embodiment explained above, the distance D1 (See FIG. 3) in the right-to-left direction between the left end of the detected part 70 and the left side wall 42 when the detected rotational body 50 is in the first position is identical to the distance D3 (See FIG. 13) in the right-to-left direction between the left end of the detected part 70 and the left side wall 42 when the detected rotational body 50 is in the third position. However, the distance D3 may be larger or smaller than the distance D1 so long as the distance D3 is smaller than the distance D2 (See FIG. 9) in the right-to-left direction between the left end of the detected part 70 and the left side wall 42.

(3) Modified Embodiment 3

In the configuration of the embodiment explained above, the left end of the detected part 70 is arranged substantially flush with the left end surface of the detecting side gear cover 90 when the detected rotational body 50 is in the first or third position. However, the left end of the detected part 70 may be completely hidden within the detecting side gear cover 90, or may substantially project out from the detecting side gear cover 90, when the detected rotational body 50 is in the first or third position.

(4) Modified Embodiment 4

If the sliding part 79 only includes, on its left side surface, a parallel surface running parallel to the left side wall 42, a circular arc-shaped supporting part (instead of the supporting part 75 of the detected rotational body 50) may be configured around the center axis line 681 on the right side surface of the toothless gear part 69, and an inclined surface may be formed on the right end surface of that supporting part in such a way that the inclined surface is more apart from the left side wall 42 as it goes downstream of the rotational direction R of the detected rotational body 50. This configuration may also allow the detected rotational body 50 to move from the first position to the third position in response to the rotation of the detected rotational body 50.

(5) Modified Embodiment 5

In the configuration of the embodiment explained above, the detected rotational body 50 includes the toothless gear part 69, and the sliding part 79 is configured between the left side wall 42 and the detected rotational body 50. Further, the driving force is transmitted from the second agitator gear 65 to the toothless gear part 69, and the detected part 70 advances or retracts, while rotating in the rotational direction R, in response to the rotation of the detected rotational body 50. Instead of this configuration, the features illustrated in FIGS. 15 and 16 may be employed.

Figure 16:
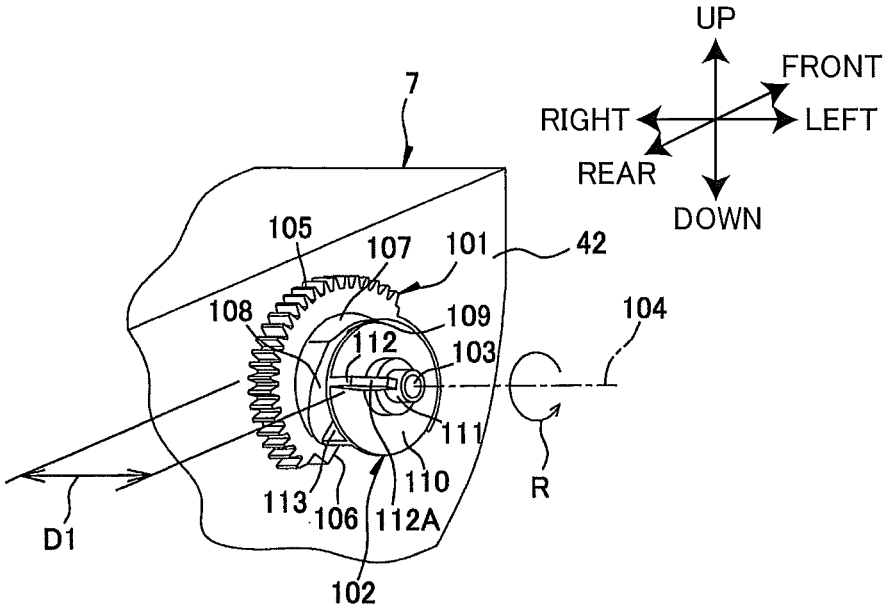
FIG. 16 is a perspective view of a substantial part of the developing cartridge shown in FIG. 15 from the vantage point of the left-rear-top of the cartridge, wherein a gear cover is removed.

Specifically, in the configuration illustrated in FIG. 16, a toothless gear 101 as an embodiment of a rotational body and a detection body 102 are provided on the outer side of the left side wall 42.

The toothless gear 101 is arranged front above the second agitator gear 65 (See FIG. 3), the same arrangement as the detected rotational body 50 in FIG. 3. The toothless gear 101 is provided rotatably around the center axis line 104, which is an example of the third axis line, of a rotation axis 103 extending in the right-to-left direction. The rotation axis 103 is unrotatably supported on the left side wall 42.

Further, the toothless gear 101 is substantially in the shape of a half-circular plate, and includes gear teeth 105 on its circumferential surface. Specifically, the toothless gear 101 is similar to a fan-shaped plate when viewed from the side of about 205-degree angle. A toothless portion 106 is allocated on a flat-shaped portion on the circumferential surface of the toothless gear 101, and the gear teeth 105 is formed on the remaining arc-shaped portion (other than the toothless portion 106) of the circumferential surface. Depending on the rotational position of the toothless gear 101, the gear teeth 105 may be engaged with the second agitator gear 65.

The toothless gear 101 includes a sliding part 107 formed integrally on the left end surface (outer surface) of the gear 101. The sliding part 107 includes (a) an inclined surface 108 so tilted as to be more apart from the left side surface (the left side wall 42) of the toothless gear 101 as it goes upstream in the rotational direction R, which is an example of the second direction of the toothless gear 101, and (b) a parallel surface 109 extending continuously from the upstream of the inclined surface 108 in the rotational direction R and running parallel to the left side surface (the left side wall 42) of the toothless gear 101.

The detection body 102 is supported on the rotation axis 103, and is provided movably (reciprocable) in the right-to-left direction. The detection body 102 includes, as an integral body, a circular plate-shaped body 110, an insert-penetrating boss 111 as a projection portion and a detected part 112 projecting from the left side surface (outer surface) of the body 110, and a supporting part 113, as an embodiment of a contact part, projecting from the right side surface (inner surface) of the body 110.

The insert-penetrating boss 111 has a cylindrical shape coaxially arranged with the body 110. The detection body 102 is provided movably along the rotation axis 103 by inserting the rotation axis 103 into the insert-penetrating boss 111, and by passing the rotation axis 103 through the insert-penetrating boss 111, in a freely movable way.

The detected part 112 is in a plate shape extending both in the right-to-left direction and in the diametric direction of the body 110 on the left side surface of the body 110. Further, the detected part 112 has a trapezoidal shape, as viewed from the top, including an inclined surface 112A so tilted as to be closer to the left side as it goes to the front.

The supporting part 113 has the shape of a rectangular plate extending both in the right-to-left direction and in the diametric direction of the body 110.

Figure 15:
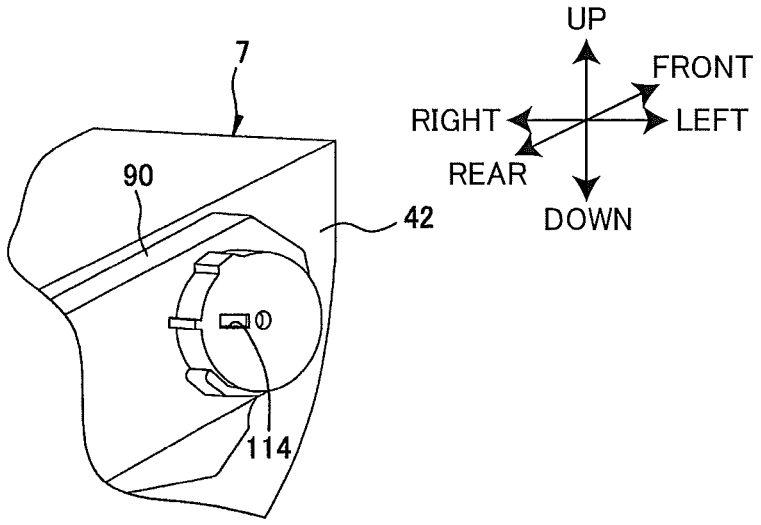
FIG. 15 is a perspective view of a substantial part of the developing cartridge according to a modified embodiment 6 from the vantage point of the left-rear-top of the cartridge.

As shown in FIG. 15, instead of the opening 89 as illustrated in FIG. 2, a rectangular shaped opening 114 is formed at the place of the detecting side gear cover 90 at a position in confrontation with the detected part 112.

In a new developing cartridge 7, as illustrated in FIG. 16, the supporting part 113 of the detection body 102 is located downstream from the inclined surface 108 of the sliding part 107 in the rotational direction R, and thus is in contact with the left side surface of the toothless gear 101. Further, the lowermost portion of the gear teeth 105 of the toothless gear 101 downstream in the rotational direction R is engaged with the gear teeth 66 of the second agitator gear 65. Moreover, the detected part 112 is accommodated in the detecting side gear cover 90, and thus is not protruded out of the opening 114.

The position of the detection body 102 in the right-to-left direction at this moment is an example of a first position as an initial position. Further, the distance D1 (See FIG. 16) in the right-to-left direction between the left end of the detected part 112 and the left side wall 42 is an example of a first distance.

In a new developing cartridge 7, the gear teeth 66 of the second agitator gear 65 are engaged with the gear teeth 105 of the detection body 102. Thus, when the second agitator gear 65 rotates in the course of the warm-up operation of the laser printer 1, the toothless gear 101 rotates in the rotational direction R subject to the rotation of the second agitator gear 65. The rotation of the toothless gear 101 allows the supporting part 113 of the detection body 102 to slide toward the inclined surface 108 on the left side surface of the toothless gear 101, and consecutively to slide toward the parallel surface 109 on the inclined surface 108. Accordingly, the detection body 102 moves gradually leftwards. That is, the detection body 102 advances gradually in the left direction without any rotational movement, and, thus, the left end of the detection body 102 projects out from the opening 114 of the detecting side gear cover 90.

Moreover, when the supporting part 113 moves onto the parallel surface 109 in response to the rotation of the toothless gear 101, the distance in the right-to-left direction between the left end of the detected part 112 and the left side wall 42 becomes the maximum, thereby making the position of the detection body 102 the second position.

Afterwards, when the toothless gear 101 rotates further, the supporting part 113 falls down from the parallel surface 109 to the left side surface of the toothless gear 101. The detection body 102 then moves to the right at a stroke by the pressure of the coil spring 146 (see FIG. 3). As a result, the detected part 112 retracts to the right, and its front end sinks under the detecting side gear cover 90, thereby making the position of the detection body 102 the third position.

The detection body 102 is detected by a measuring unit (not shown) attached to the body casing 2 when the distance in the right-to-left direction between the left end of the detected part 112 and the left side wall 42 is the maximum. For example, a light sensor including a light emitting element and a light receiving element, both of which face each other, is attached to the body casing 2. An actuator is provided at a place facing the detected part 112 in the right-to-left direction in the body casing 2, and may swing around an axis line extending in the right-to-left direction. While the detection body 102 is displaced from the first position to the second position, the inclined surface 112A of the detected part 112 is in contact with the actuator. As the detected part 112 moves accordingly, the inclined surface 112A pushes away the actuator, which then runs away off the detected part 112 backwards. Then, when the distance in the right-to-left direction between the left end of the detected part 112 and the left side wall 42 is the maximum, the actuator becomes arranged along the light path from the light emitting element to the light receiving element, and thus shields the light path. In this manner, the detection body 102 may be detected by the light sensor.

The configurations shown in FIGS. 15 and 16 may accomplish the same technical effects as the embodiment previously explained.

As mentioned above, the supporting part 113 of the detection body 102 has the shape of a rectangular plate extending both in the right-to-left direction and in the diametric direction of the body 110, and the sliding part 107 of the toothless gear 101 includes the inclined surface 108 and the parallel surface 109. Alternatively, the supporting part 113 may include (a) an inclined surface so tilted that the inclined surface is more away from the right side surface of the body 110 of the detection body 102 as it goes upstream in the rotational direction R of the toothless gear 101, and (b) an parallel surface extending from the upstream of the inclined surface in the rotational direction and running parallel to the right side surface of the body 110. In this alternative features, the sliding part 107 of the toothless gear 101 has the shape of a rectangular plate extending both in the right-to-left direction and in the diametric direction of the toothless gear 101.

In the modified embodiment 6, the detection body 102 is urged toward the left side surface 42 by the coil spring 146. However, as in the modified embodiment 1, a boss may be provided on the outer surface of the left side wall 42, a wire spring may be coiled around the boss, and the detection body 102 may be urged toward the left side surface 42 by the wire spring.

(6) Modified Embodiment 6

Figure 17:
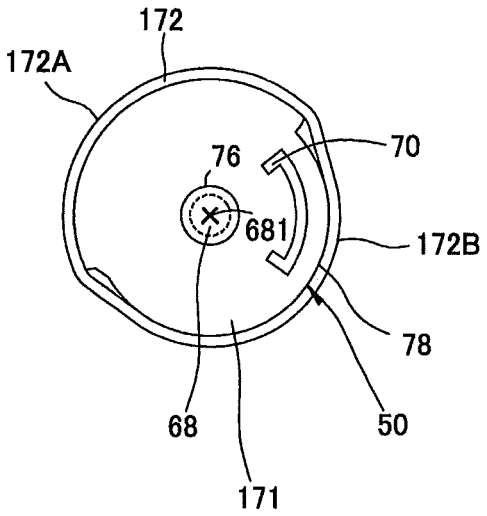
FIG. 17 is an explanatory diagram for the developing cartridge of an modified embodiment 7.

In the configurations of the embodiment explained above, the detected rotational body 50 includes the toothless gear part 69, and the gear teeth 77 is formed on the circumferential surface of the toothless gear part 69. Instead of the toothless gear part 69, for example, it may be alternatively introduced as illustrated in FIG. 17 that a body 171 is similar to a fan-shaped plate around the rotation axis 68 of the detected rotational body 50, and that a resistance-generating member 172 is made of a material of a higher coefficient of friction such as rubber and is wound around the circumference of the body 171. In this case, the circumferential surface of the second agitator gear 65 may, or need not, include the gear teeth 66. The body 171 and the resistance-generating member 172 are designed in such a way that a portion 172B having a smaller diameter than the outer diameter of the resistance-generating member 172 is not in contact with the second agitator gear 65, and an arc surface 172A of the member 172 is in contact with the circumferential surface of the second agitator gear 65.

(7) Modified Embodiment 7

Figure 18:
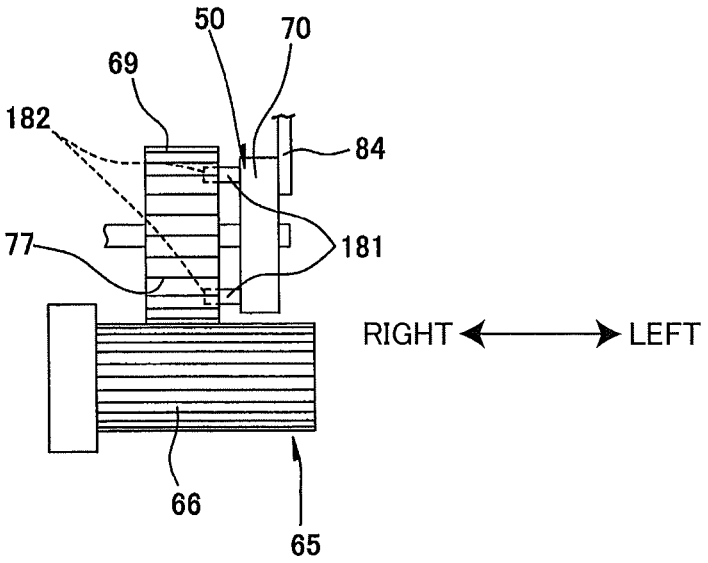
FIG. 18 is an explanatory diagram for the developing cartridge of an modified embodiment 8.

In the configurations of the embodiment explained above, the detected rotational body 50 includes the detected part 70 projected from the left side surface of the toothless gear part 69. Alternatively, as illustrated in FIG. 18, the detected part 70 may be made as an integral body, while the toothless gear part 69 is separately made from such integral body. The integral body may be coupled with the separate toothless gear part 69 so as not to allow the relative rotation but to allow the rotation as a whole.

In this structure, for example, two bosses 181 are formed in the integral body, and two corresponding recesses 182 are formed in the toothless gear part 69. Then, by fitting each boss 181 to each recess 182, the integral body and the toothless gear party 69 may be connected to rotate at a whole.

(8) Modified Embodiment 8

Figure 19:
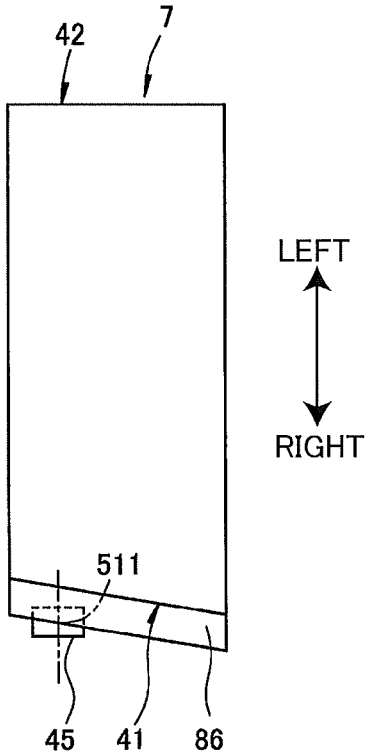
FIG. 19 is an explanatory diagram for the developing cartridge of an modified embodiment 9.

In the configurations of the embodiment explained above, the right and left side walls 41 and 42 extend for- and backwards (in the front-to-back direction). However, as illustrated in FIG. 19, for example, the right side wall 41 may extend in a transverse direction across the front-to-back direction. In this case, the longitudinal direction in which the right and left side walls 41 and 42 face each other may be the right-to-left direction, i.e., the transverse direction crossing the right side wall 41 at a right angle. Further, the input gear 45 may be provided rotatably around the center axis line 511 extending in the right-to-left direction. Alternatively, the longitudinal direction in which the right and left side walls 41 and 42 face each other may be the transverse direction crossing the right side wall 41 at a right angle, and the input gear 45 may be provided rotatably around the center axis line 511 extending in that transverse direction.

(9) Modified Embodiment 9

Figure 20:
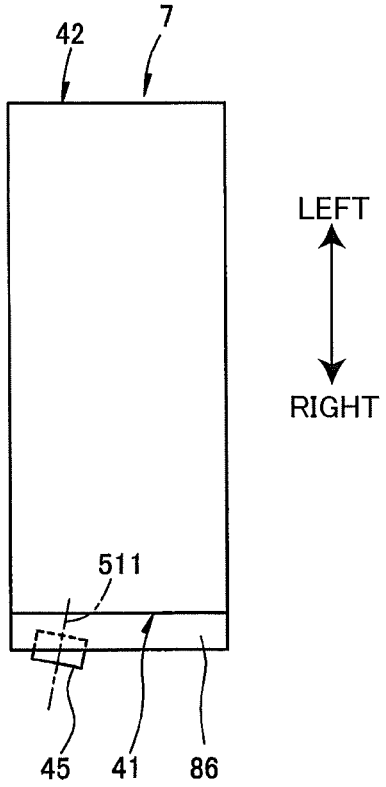
FIG. 20 is an explanatory diagram for the developing cartridge of a modified embodiment 10.

Further, in the configuration where the right and left side walls 41 and 42 extend in the front-to-back direction, the longitudinal direction in which the right and left side walls 41 and 42 face each other is not limited to the right-to-left direction, i.e., the transverse direction crossing the right and left side walls 41 and 42 at a right angle, and may include a direction in which a certain portion of the right side wall 41 faces a certain portion of the left side wall 42. In other words, as illustrated in FIG. 20, the direction facing the right and left side walls 41 and 42 includes an inclined direction with respect to the right-to-left direction, and the input gear 45 may be provided rotatably around the center axis line 511 extending in such an inclined direction.

(10) Modified Embodiment 10

Regarding the embodiment and the modified embodiments, the invention is explained above as an example when it applies to a developing cartridge 7. However, the invention herein is not limited to a developing cartridge 7, and may apply to any cartridge other than a developing cartridge, such as the feature excluding the developing roller 18, i.e., a developer cartridge accommodating only a developer or both a developer and an agitator in a housing.

What is claimed is:

1. A cartridge comprising:

a housing including a developer accommodating portion configured to accommodate developer therein, a first side wall, and a second side wall opposed to the first side wall in a longitudinal direction, the developer accommodating portion being interposed between the first side wall and the second side wall;

a receiving member configured to receive a driving force from outside, located at an opposite side from the developer accommodating portion with respect to the first side wall, and rotatable around a first axis line extending parallel to the longitudinal direction;

a rotating member provided between the first and second side walls so as to be rotatable around a second axis line extending parallel to the first axis line, and configured to be rotated by the driving force received by the receiving member; and a detection body located at an opposite side from the developer accommodating portion with respect to the second side wall and including a detected part which is configured to be detected by an external detecting unit, wherein the detection body is configured to advance outwards in the longitudinal direction with respect to the second side wall and retract inwards in the longitudinal direction with respect to the second side wall by the driving force received by the receiving member which is transferred through the rotating member.

2. The cartridge according to claim 1, wherein the detection body is reciprocable in a moving direction parallel to the first axis line, and wherein, the detection body is movable from a first position where a distance in the moving direction between the detection body and the second side wall is a first distance, via a second position where the distance in the moving direction between the detection body and the second side wall is a second distance larger than the first distance, to a third position where the distance in the moving direction between the detection body and the second side wall is a third distance smaller than the second distance.

3. The cartridge according to claim 2, wherein the first distance is the same as the third distance.

4. The cartridge according to claim 2, wherein the detection body is configured to rotate around a third axis line extending parallel to the first axis line, and is configured to move from the first position, via the second position, to the third position, by the rotation in a first direction, wherein the second side wall includes a sliding part on which a contact part of the detection body slides while the detection body moves from the first position to the third position, and wherein one of the contact part and the sliding part includes an inclined surface so tilted as to be more apart from the second side wall as the inclined surface extends downstream in the first direction.

5. The cartridge according to claim 4, wherein the one of the contact part and the sliding part, including the inclined surface, includes a parallel surface extending continuously from the inclined surface downstream in the first direction and running parallel to the second side wall.

6. The cartridge according to claim 4 further comprising a transmission gear configured to transmit the driving force received by the receiving member to the detection body, wherein the detection body includes a circumferential surface around the third axis line, wherein the detection body has a toothless portion formed on a part of the circumferential surface, and gear teeth formed on the remaining portion other than the toothless portion of the circumferential surface, and wherein the gear teeth are configured to be engaged with the transmission gear while the detection body moves from the first position to the third position.

7. The cartridge according to claim 4 further comprising a pressing member configured to press the detection body to the second side wall.

8. The cartridge according to claim 7, further comprising a projection portion projecting from the second side wall in the moving direction, wherein the pressing member includes a wire spring coiled around the projection portion and having one end contact a side of the detection body opposite to the second side wall.

9. The cartridge according to claim 8, wherein the detection body includes a pressed surface with which the one end of the wire spring is in contact in the first direction when the detection body is in the third position.

10. The cartridge according to claim 2, further comprising a rotational body located at an opposite side from the developer accommodating portion with respect to the second side wall so as to be rotatable around a third axis line extending parallel to the first axis line, the rotational body being configured to be rotated in a second direction by the driving force received by the receiving member, wherein the detection body is provided so as to be reciprocable in the moving direction parallel to the first axis line, and to maintain the position of the detection body around the third axis line, wherein the rotational body includes an inclined surface on which a contact part of the detection body slides while the detection body moves from the first position to the third position, and wherein the inclined surface is tilted so as to be more apart from the second side wall as the inclined surface extends upstream in the second direction.

11. The cartridge according to claim 10, wherein the rotational body includes a parallel surface extending continuously from the inclined surface upstream in the second direction and running parallel to the second side wall.

12. The cartridge according to claim 10 further comprising a transmission gear configured to transmit the driving force received by the receiving member to the rotational body, wherein a toothless portion is formed on a portion of a circumferential surface around the third axis line, and gear teeth are formed on the remaining portion other than the toothless portion of the circumferential surface, and wherein the gear teeth are configured to be engaged with the transmission gear while the detection body moves from the first position to the third position.

13. The cartridge according to claim 10 further comprising a pressing member configured to press the detection body against the second side wall.

14. The cartridge according to claim 13, further comprising a projection portion projecting from the second side wall in the moving direction, wherein the pressing member includes a wire spring coiled around the projection portion and having one end contact a side of the detection body opposite to the second side wall.

15. The cartridge according to claim 13 further comprising a cover attached to the second side wall on an opposite side from the developer accommodating portion to cover the detection body, and wherein the pressing member includes a coil spring interposed between the detection body and the cover and contacting the detection body.

16. The cartridge according to claim 2 further comprising a cover attached to the second side wall on an opposite side from the developer accommodating portion to cover the detection body, and wherein the detection body is arranged within the cover when the detection body is in the first and third positions, and the detection body is exposed from the cover when the detection body is in the second position.

17. The cartridge according to claim 1, wherein the rotating member is an agitator configured to agitate the developer in the developer accommodating portion, wherein the cartridge further comprises a developing roller provided between the first and the second side walls so as to be rotatable around a fourth axis line extending parallel to the first axis line at a distance, and to be rotated by the driving force received by the receiving member.

18. A cartridge comprising:

a housing including a developer accommodating portion configured to accommodate developer therein, a first side wall, and a second side wall opposed to and away from the first side wall in a longitudinal direction, the developer accommodating portion being interposed between the first side wall and the second side wall;

a receiving member configured to receive a driving force from outside and located at an opposite side from the developer accommodating portion with respect to the first side wall, the receiving member being rotatable around a first axis line extending parallel to the longitudinal direction;

a rotating member provided between the first and second side walls so as to be rotatable around a second axis line extending parallel to the first axis line, the receiving member being configured to transmit the driving force from outside to the rotating member, the rotating member being configured to be rotated by the driving force transmitted from the receiving member;

a detection body located at an opposite side from the developer accommodating portion with respect to the second side wall and including a detected part which is configured to be detected by an external detecting unit; and a transmission member configured to transmit the driving force from the rotating member to the detection body, the transmission member being located at the opposite side from the developer accommodating portion with respect to the second side wall, wherein the detection body is configured to advance in the longitudinal direction so as to be moved away from the second side wall and retract in a direction opposite to the longitudinal direction so as to be moved toward the second side wall by the driving force transmitted from the transmission member.

19. The cartridge according to claim 18, wherein the detection body is reciprocable in the longitudinal direction and the direction opposite to the longitudinal direction, and wherein, the detection body is movable from a first position where a distance in the longitudinal direction between the detection body and the second side wall is a first distance, via a second position where the distance in the longitudinal direction between the detection body and the second side wall is a second distance larger than the first distance, to a third position where the distance in the longitudinal direction between the detection body and the second side wall is a third distance smaller than the second distance.

20. The cartridge according to claim 19, wherein the first distance is the same as the third distance.

21. The cartridge according to claim 19, wherein the detection body is configured to rotate in a first direction around a third axis line extending parallel to the first axis line, and is configured to move from the first position, via the second position, to the third position, while rotating in the first direction, wherein the second side wall includes a sliding part on which a contact part of the detection body slides while the detection body moves from the first position to the third position, and wherein one of the contact part and the sliding part includes an inclined surface so tilted as to be more apart from the second side wall as the inclined surface extends downstream in the first direction.

22. The cartridge according to claim 21, wherein the one of the contact part and the sliding part, including the inclined surface, includes a parallel surface extending continuously from the inclined surface downstream in the first direction and running parallel to the second side wall.

23. The cartridge according to claim 21, wherein the detection body includes a circumferential surface around the third axis line, wherein the detection body has a toothless portion formed on a part of the circumferential surface, and gear teeth formed on the remaining portion other than the toothless portion of the circumferential surface, and wherein the gear teeth are configured to be engaged with the transmission member while the detection body moves from the first position to the third position.

24. The cartridge according to claim 21, further comprising a pressing member configured to press the detection body to the second side wall.

25. The cartridge according to claim 24, further comprising a projection portion projecting from the second side wall in the longitudinal direction, wherein the pressing member includes a wire spring coiled around the projection portion and having one end contact a side of the detection body opposite to the second side wall.

26. The cartridge according to claim 25, wherein the detection body includes a pressed surface with which the one end of the wire spring is in contact in the first direction when the detection body is in the third position.

27. The cartridge according to claim 19, further comprising a rotational body located at an opposite side from the developer accommodating portion with respect to the second side wall so as to be rotatable around a third axis line extending parallel to the first axis line, the rotational body being configured to be rotated in a second direction by the driving force transmitted from the transmission member, wherein the detection body is provided so as to be reciprocable in the longitudinal direction and the direction opposite to the longitudinal direction, and to maintain the position of the detection body around the third axis line, wherein the rotational body includes an inclined surface on which a contact part of the detection body slides while the detection body moves from the first position to the third position, and wherein the inclined surface is tilted so as to be more apart from the second side wall as the inclined surface extends upstream in the second direction.

28. The cartridge according to claim 27, wherein the rotational body includes a parallel surface extending continuously from the inclined surface upstream in the second direction and running parallel to the second side wall.

29. The cartridge according to claim 27, wherein the transmission member being further configured to transmit the driving force from the rotating member to the rotational body, wherein a toothless portion is formed on a portion of a circumferential surface of the rotational body around the third axis line, and gear teeth are formed on the remaining portion other than the toothless portion of the circumferential surface, and wherein the gear teeth are configured to be engaged with the transmission member while the detection body moves from the first position to the third position.

30. The cartridge according to claim 27, further comprising a pressing member configured to press the detection body against the second side wall.

31. The cartridge according to claim 30, further comprising a projection portion projecting from the second side wall in the longitudinal direction, wherein the pressing member includes a wire spring coiled around the projection portion and having one end contact a side of the detection body opposite to the second side wall.

32. The cartridge according to claim 30, further comprising a cover attached to the second side wall on an opposite side from the developer accommodating portion to cover the detection body, and wherein the pressing member includes a coil spring interposed between the detection body and the cover and contacting the detection body.

33. The cartridge according to claim 19, further comprising a cover attached to the second side wall on an opposite side from the developer accommodating portion to cover the detection body, and wherein the detection body is arranged within the cover when the detection body is in the first and third positions, and the detection body is exposed from the cover when the detection body is in the second position.

34. The cartridge according to claim 18, wherein the rotating member is an agitator configured to agitate the developer in the developer accommodating portion, wherein the cartridge further comprises a developing roller provided between the first and the second side walls so as to be rotatable around a fourth axis line extending parallel to the first axis line at a distance, and to be rotated by the driving force received by the receiving member.

35. A cartridge comprising:

a housing including a developer accommodating portion configured to accommodate developer therein, a first side wall, and a second side wall opposed to and away from the first side wall in a longitudinal direction, the developer accommodating portion being interposed between the first side wall and the second side wall;

a receiving member configured to receive a driving force from outside and located at an opposite side from the developer accommodating portion with respect to the first side wall, the receiving member being rotatable around a first axis line extending parallel to the longitudinal direction;

a rotating member provided between the first and second side walls so as to be rotatable around a second axis line extending parallel to the first axis line and configured to be rotated by the driving force received by the receiving member; and a detection body located at an opposite side from the developer accommodating portion with respect to the second side wall and including a detected part which is configured to be detected by an external detecting unit, wherein the detection body is configured to, upon rotation of the rotating member, advance in the longitudinal direction so as to be moved away from the second side wall and then retract in a direction opposite to the longitudinal direction so as to be moved toward the second side wall.

36. The cartridge according to claim 35, wherein the detection body is reciprocable in the longitudinal direction and the direction opposite to the longitudinal direction, and wherein, the detection body is movable from a first position where a distance in the longitudinal direction between the detection body and the second side wall is a first distance, via a second position where the distance in the longitudinal direction between the detection body and the second side wall is a second distance larger than the first distance, to a third position where the distance in the longitudinal direction between the detection body and the second side wall is a third distance smaller than the second distance.

37. The cartridge according to claim 36, wherein the first distance is the same as the third distance.

38. The cartridge according to claim 36, wherein the detection body is configured to rotate in a first direction around a third axis line extending parallel to the first axis line, and is configured to move from the first position, via the second position, to the third position, while rotating in the first direction, wherein the second side wall includes a sliding part on which a contact part of the detection body slides while the detection body moves from the first position to the third position, and wherein one of the contact part and the sliding part includes an inclined surface so tilted as to be more apart from the second side wall as the inclined surface extends downstream in the first direction.

39. The cartridge according to claim 38, wherein the one of the contact part and the sliding part, including the inclined surface, includes a parallel surface extending continuously from the inclined surface downstream in the first direction and running parallel to the second side wall.

40. The cartridge according to claim 38, wherein the receiving member being configured to transmit the driving force from outside to the rotating member to rotate the rotating member, the cartridge further comprising a transmission gear configured to transmit the driving force from the rotating member to the detection body, wherein the detection body includes a circumferential surface around the third axis line, wherein the detection body has a toothless portion formed on a part of the circumferential surface, and gear teeth formed on the remaining portion other than the toothless portion of the circumferential surface, and wherein the gear teeth are configured to be engaged with the transmission gear while the detection body moves from the first position to the third position.

41. The cartridge according to claim 38, further comprising a pressing member configured to press the detection body to the second side wall.

42. The cartridge according to claim 41, further comprising a projection portion projecting from the second side wall in the longitudinal direction, wherein the pressing member includes a wire spring coiled around the projection portion and having one end contact a side of the detection body opposite to the second side wall.

43. The cartridge according to claim 42, wherein the detection body includes a pressed surface with which the one end of the wire spring is in contact in the first direction when the detection body is in the third position.

44. The cartridge according to claim 36, further comprising a rotational body located at an opposite side from the developer accommodating portion with respect to the second side wall so as to be rotatable around a third axis line extending parallel to the first axis line, the rotational body being configured to be rotated in a second direction upon rotation of the rotating member, wherein the detection body is provided so as to be reciprocable in the longitudinal direction and the direction opposite to the longitudinal direction, and to maintain the position of the detection body around the third axis line, wherein the rotational body includes an inclined surface on which a contact part of the detection body slides while the detection body moves from the first position to the third position, and wherein the inclined surface is tilted so as to be more apart from the second side wall as the inclined surface extends upstream in the second direction.

45. The cartridge according to claim 44, wherein the rotational body includes a parallel surface extending continuously from the inclined surface upstream in the second direction and running parallel to the second side wall.

46. The cartridge according to claim 44, wherein the receiving member being configured to transmit the driving force from outside to the rotating member to rotate the rotating member, the cartridge further comprising a transmission gear configured to transmit the driving force from the rotating member to the rotational body, wherein a toothless portion is formed on a portion of a circumferential surface of the rotational body around the third axis line, and gear teeth are formed on the remaining portion other than the toothless portion of the circumferential surface, and wherein the gear teeth are configured to be engaged with the transmission gear while the detection body moves from the first position to the third position.

47. The cartridge according to claim 44, further comprising a pressing member configured to press the detection body against the second side wall.

48. The cartridge according to claim 47, further comprising a projection portion projecting from the second side wall in the longitudinal direction, wherein the pressing member includes a wire spring coiled around the projection portion and having one end contact a side of the detection body opposite to the second side wall.

49. The cartridge according to claim 47, further comprising a cover attached to the second side wall on an opposite side from the developer accommodating portion to cover the detection body, and wherein the pressing member includes a coil spring interposed between the detection body and the cover and contacting the detection body.

50. The cartridge according to claim 36, further comprising a cover attached to the second side wall on an opposite side from the developer accommodating portion to cover the detection body, and wherein the detection body is arranged within the cover when the detection body is in the first and third positions, and the detection body is exposed from the cover when the detection body is in the second position.

51. The cartridge according to claim 35, wherein the rotating member is an agitator configured to agitate the developer in the developer accommodating portion, wherein the cartridge further comprises a developing roller provided between the first and the second side walls so as to be rotatable around a fourth axis line extending parallel to the first axis line at a distance, and to be rotated by the driving force received by the receiving member.

* * * * *